US008362995B2

(12) United States Patent
Hsieh et al.

(10) Patent No.: US 8,362,995 B2
(45) Date of Patent: Jan. 29, 2013

(54) LIQUID CRYSTAL DISPLAY

(75) Inventors: Ming-Feng Hsieh, Tainan (TW); Chien-Hong Chen, Tainan (TW); Chih-Yung Hsieh, Tainan (TW); I-Lin Ho, Tainan (TW); Che-Ming Hsu, Tainan (TW); Fu-Cheng Chen, Miao-Li County (TW)

(73) Assignee: Chimei Innolux Corporation, Miao-Li County (TW)

( * ) Notice: Subject to any disclaimer, the term of this patent is extended or adjusted under 35 U.S.C. 154(b) by 1203 days.

(21) Appl. No.: 11/616,934

(22) Filed: Dec. 28, 2006

(65) Prior Publication Data

US 2007/0164957 A1 Jul. 19, 2007

(30) Foreign Application Priority Data

Jan. 13, 2006 (TW) ..... 95101483 A

(51) Int. Cl.
*G09G 3/36* (2006.01)

(52) U.S. Cl. ..... 345/90

(58) Field of Classification Search ..... None
See application file for complete search history.

(56) References Cited

U.S. PATENT DOCUMENTS 6,958,791 B2 10/2005 Shimoshikiryo
7,034,789 B2 4/2006 Takeuchi et al.
7,050,038 B2 * 5/2006 Matsuda et al. ..... 345/103
2003/0227429 A1 * 12/2003 Shimoshikiryo ..... 345/90

FOREIGN PATENT DOCUMENTS

CN 1469175 A 1/2004
TW 200401933 6/1992

* cited by examiner

*Primary Examiner* — Sumati Lefkowitz
*Assistant Examiner* — Tammy Pham
(74) *Attorney, Agent, or Firm* — Lowe Hauptman Ham & Berner, LLP

(57) ABSTRACT

A multi-domain LCD panel includes data lines, scan lines and pixels. Each pixel includes first and second sub-pixels respectively having first and second storage capacitors. A first data switch is selectively coupled to a first terminal of the first capacitor and one of the data lines. A second data switch is selectively coupled to a first terminal of the second capacitor and one of the data lines. First and second bias lines are respectively coupled to second terminals of the first and second capacitors. When a corresponding scan line is enabled, the first and second data switches turn on such that a signal on the data line is transmitted to the first and second sub-pixels. After the scan line is disabled, levels of the first and second bias lines are changed such that pixel voltages of the first and second sub-pixels differ from each other.

18 Claims, 29 Drawing Sheets

LIQUID CRYSTAL DISPLAY

This application claims the benefit of Taiwan application Serial No. 95101483, filed Jan. 13, 2006, the subject matter of which is incorporated herein by reference.

BACKGROUND OF THE INVENTION

1. Field of the Invention

The invention relates in general to a LCD (Liquid Crystal Display) panel, and more particularly to a LCD panel having low color differences and multiple domains.

2. Description of the Related Art

The viewable angle of a typical LCD is not large, so the colors of the frame become incorrect when the display is viewed at a large tilt angle. The LCD with the larger screen suffers from the drawback of the uneven brightness over the middle and periphery portions of the frame. Thus, manufacturers have paid a great deal of attention to the development of various LCDs with wide viewing angles, such as an IPS (In-Plane Switching) LCD, a MVA (Multi-domain Vertical Alignment) LCD, and the like.

In the MVA LCD, one pixel is divided into a plurality of domains. Arranging directions of liquid crystal molecules in each domain are slightly different from one another such that the difference is not too great when the display is viewed with different viewing angles.

However, the colors of the frame of the multi-domain LCD viewed with different viewing angles still exhibit some differences, so the frame quality thereof requires further improvement.

In a conventional driving method of solving the color difference, one pixel in the LCD panel is divided into two sub-pixels each having a thin film transistor for control. Thus, the slightly different driving voltages may be respectively inputted to the two sub-pixels of the pixel so that the phenomenon of the color difference can be improved.

SUMMARY OF THE INVENTION

The invention is directed to a multi-domain LCD, which has the low color differences and the enhanced frame quality.

According to the present invention, a LCD (Liquid Crystal Display) panel includes data lines, scan lines and pixels. Each pixel includes a first sub-pixel and a second sub-pixel, which respectively have a first storage capacitor and a second storage capacitor. A first data switch is selectively coupled to a first terminal of the first storage capacitor and one of the data lines. A second data switch is selectively coupled to a first terminal of the second storage capacitor and one of the data lines. A first bias line is coupled to a second terminal of the first storage capacitor. A second bias line is coupled to a second terminal of the second storage capacitor. When the scan line is enabled, the first data switch and the second data switch turn on such that the signal on the data line is transmitted to the first sub-pixel and the second sub-pixel. Next, after the scan line is disabled, levels of the first bias line and the second bias line are respectively changed such that pixel voltages of the first sub-pixel and the second sub-pixel slightly different from each other.

The invention will become apparent from the following detailed description of the preferred but non-limiting embodiments. The following description is made with reference to the accompanying drawings.

DETAILED DESCRIPTION OF THE INVENTION

First Embodiment

Figure 1A:
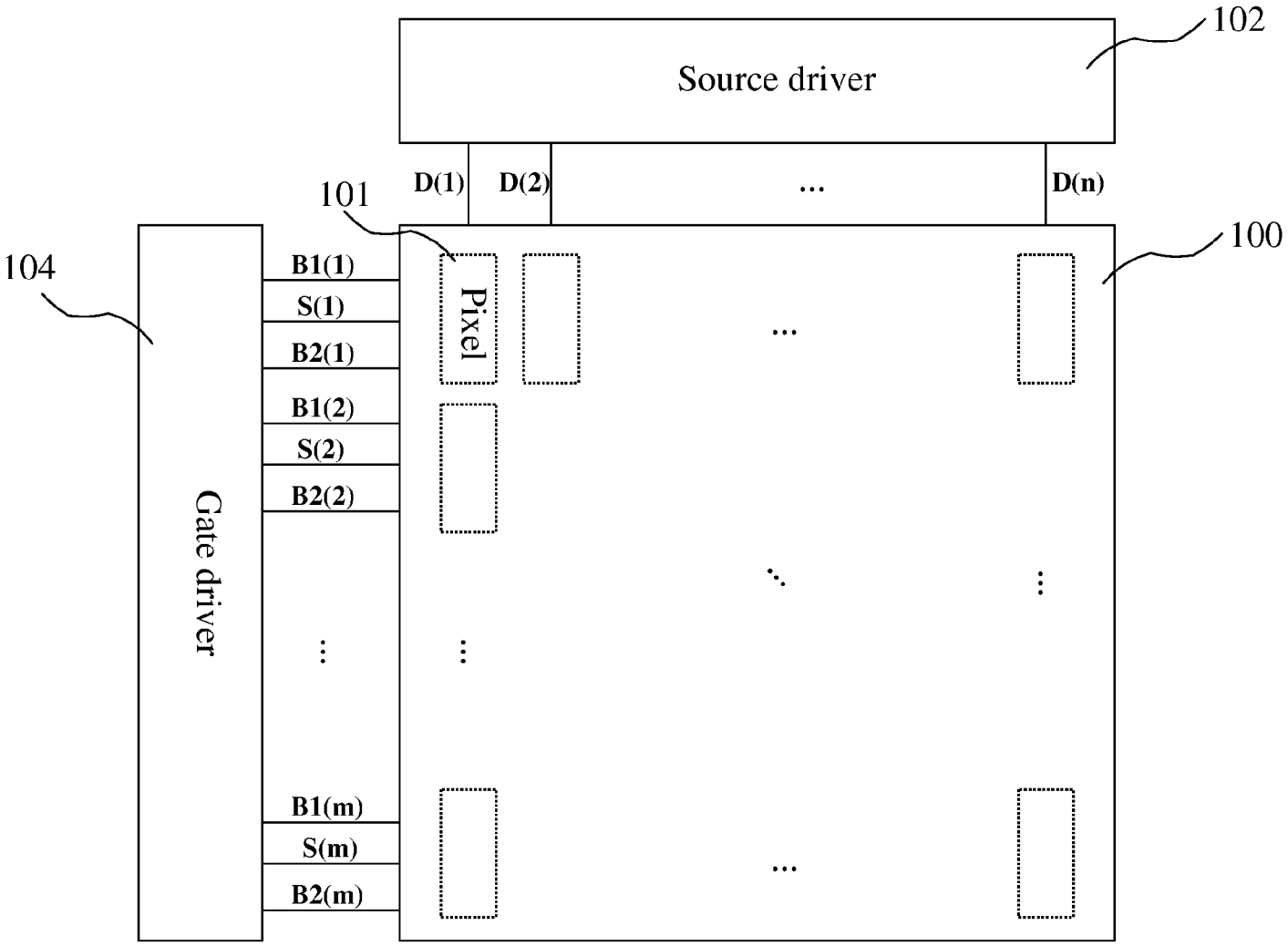
FIG. 1A shows a multi-domain LCD module according to a first embodiment of the invention.

FIG. 1A shows a multi-domain LCD module according to a first embodiment of the invention. Referring to FIG. 1A, the LCD module includes a LCD panel 100, a source driver 102 and a gate driver 104. The LCD panel 100 includes n*m pixels 101. The source driver 102 transmits display data to the pixels 101 through data lines D(1) to D(n). The gate driver 104 transmits a scan signal to the LCD panel 100 to sequentially turn on each column of pixels through scan lines S(1) to S(m), and transmits a first bias signal and a second bias signal to each pixel 101 on the LCD panel 100 through first bias lines B1(1) to B1(m) and second bias lines B2(1) to B2(m).

Figure 1B:
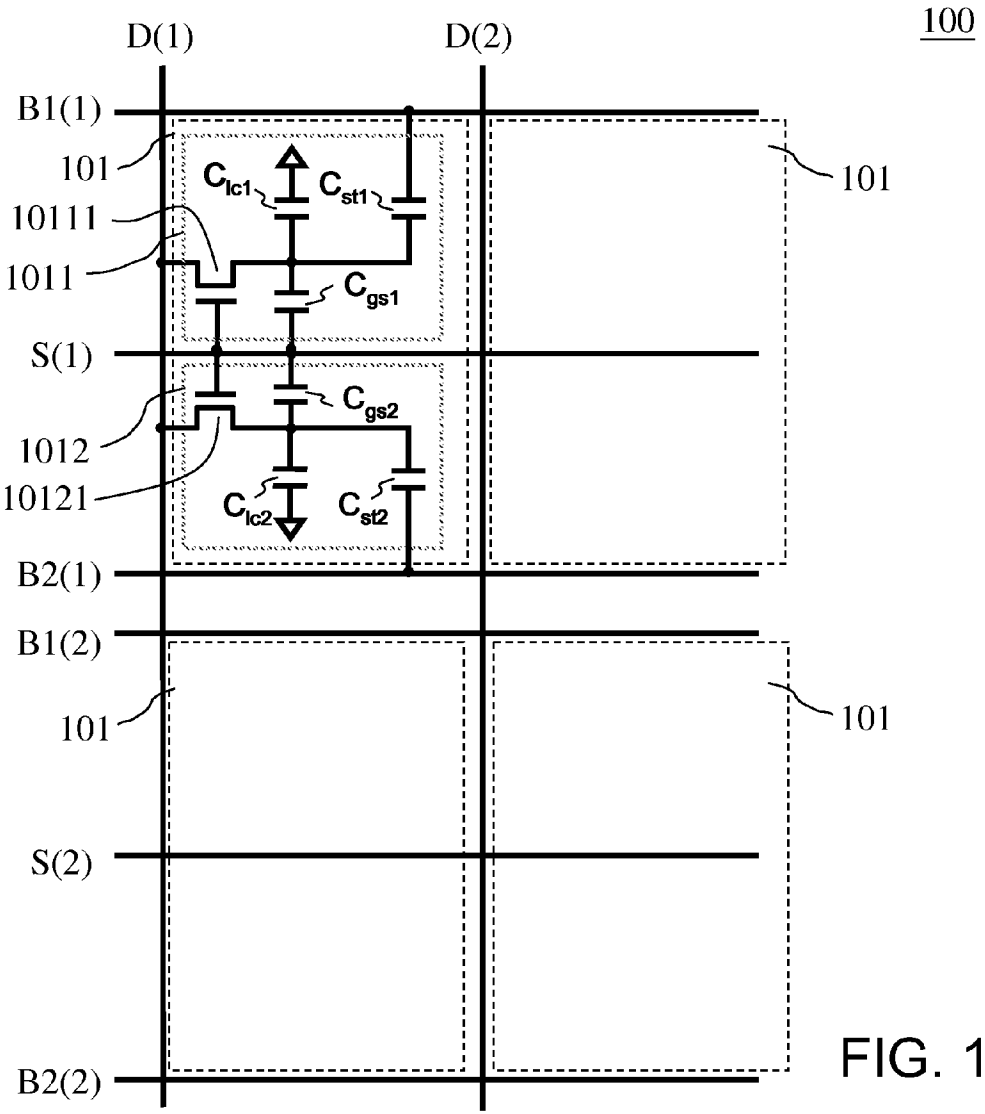
FIG. 1B shows an equivalent circuit diagram of one portion of the LCD panel.

FIG. 1B shows an equivalent circuit diagram of one portion of the LCD panel 100. Referring to FIG. 1B, the LCD panel 100 includes a plurality of pixels 101 arranged in a matrix, a first bias line B1 and a second bias line B2 parallel to each other, a plurality of parallel scan lines S and a plurality of parallel data lines D. The scan lines S, the first bias line B1 and the second bias line B2 are substantially parallel to one another and perpendicular to the data lines D. Each pixel 101 corresponds to one data line D, one scan line S, one first bias line B1 and one second bias line B2.

The pixel 101 includes a first sub-pixel 1011 and a second sub-pixel 1012. The first sub-pixel 1011 includes a thin film transistor 10111, a storage capacitor $C_{st1}$, and a parasitic capacitor $C_{gs1}$ formed between a gate and a source of the thin film transistor 10111. The thin film transistor 10111 has the gate coupled to the scan line S(1), the drain coupled to the data line D(1) and a source coupled to a first terminal of a liquid crystal equivalent capacitor $C_{lc1}$ and a first terminal of the storage capacitor $C_{st1}$. The potential of the source of the thin film transistor 10111 is $v_{s1}$, a second terminal of the liquid crystal equivalent capacitor $C_{lc1}$ is coupled to a common electrode having the voltage of $V_{com}$, and a second terminal of the storage capacitor $C_{st1}$ is coupled to the first bias line B1(1). The second sub-pixel 1012 includes a thin film transistor 10121, a liquid crystal equivalent capacitor $C_{lc2}$, a storage capacitor $C_{st2}$ and a parasitic capacitor $C_{gs2}$ formed between the gate and the source of the thin film transistor 10121. The thin film transistor 10121 has a gate coupled to the scan line S(1), a drain coupled to the data line D(1), and a source coupled to a first terminal of the liquid crystal equivalent capacitor $C_{lc2}$ and a first terminal of the storage capacitor $C_{st2}$. The potential of the source of the thin film transistor 10121 is $v_{s2}$, a second terminal of the liquid crystal equivalent capacitor $C_{lc2}$ is coupled to the common electrode having the voltage of $V_{com}$, and a second terminal of the storage capacitor $C_{st2}$ is coupled to the first bias line B2(1). The storage capacitor $C_{st1}$ of the first sub-pixel 1011 is formed by the source of the thin film transistor 10111 and the first bias line B1(n), and the storage capacitor $C_{st2}$ of the second sub-pixel 1012 is formed by the source of the thin film transistor 10121 and the second bias line B2(n).

Figure 2A:
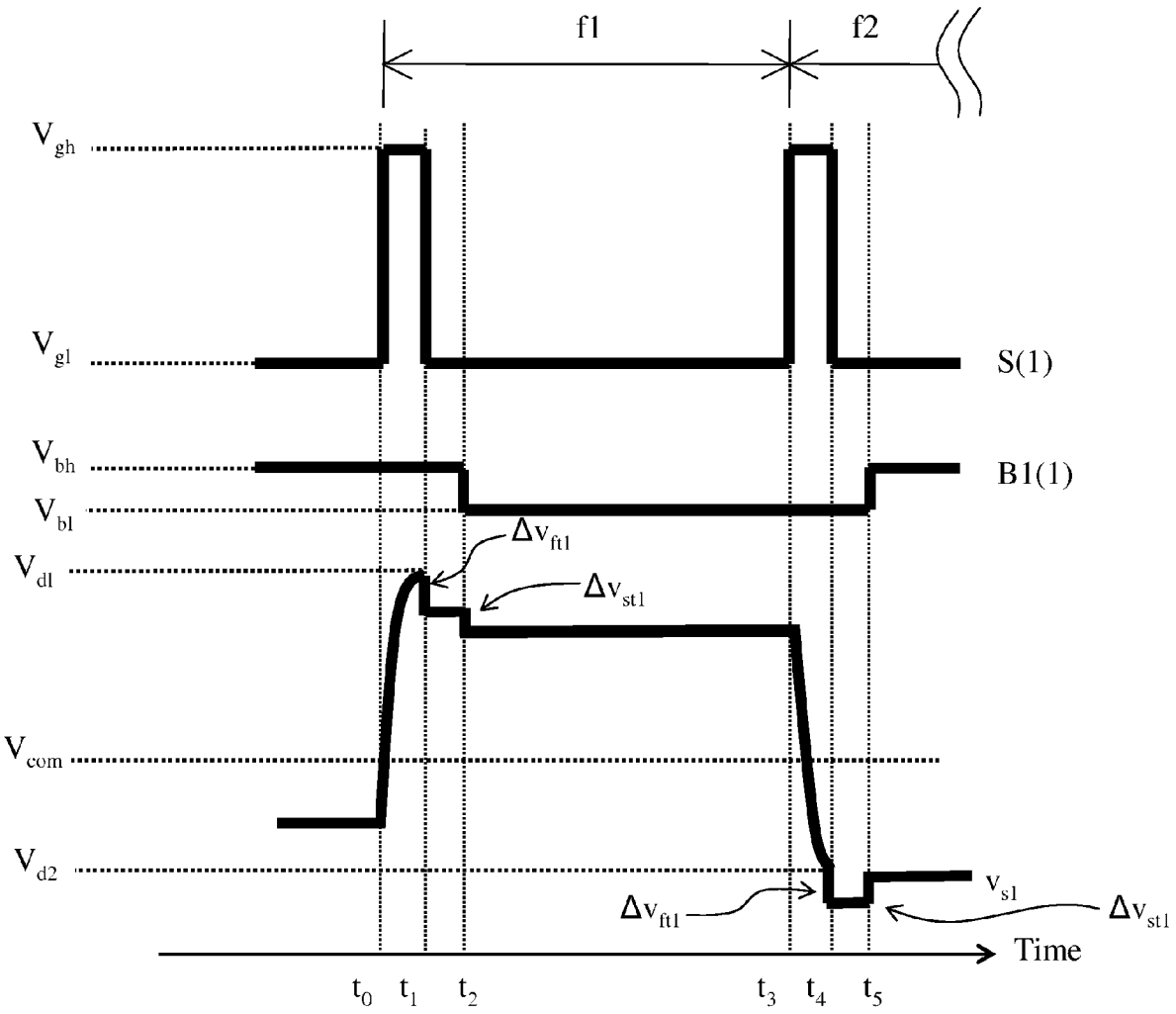
FIGS. 2A and 2B respectively show signal waveforms of a first sub-pixel and a second sub-pixel of the LCD panel according to a first driving method.
Figure 2B:
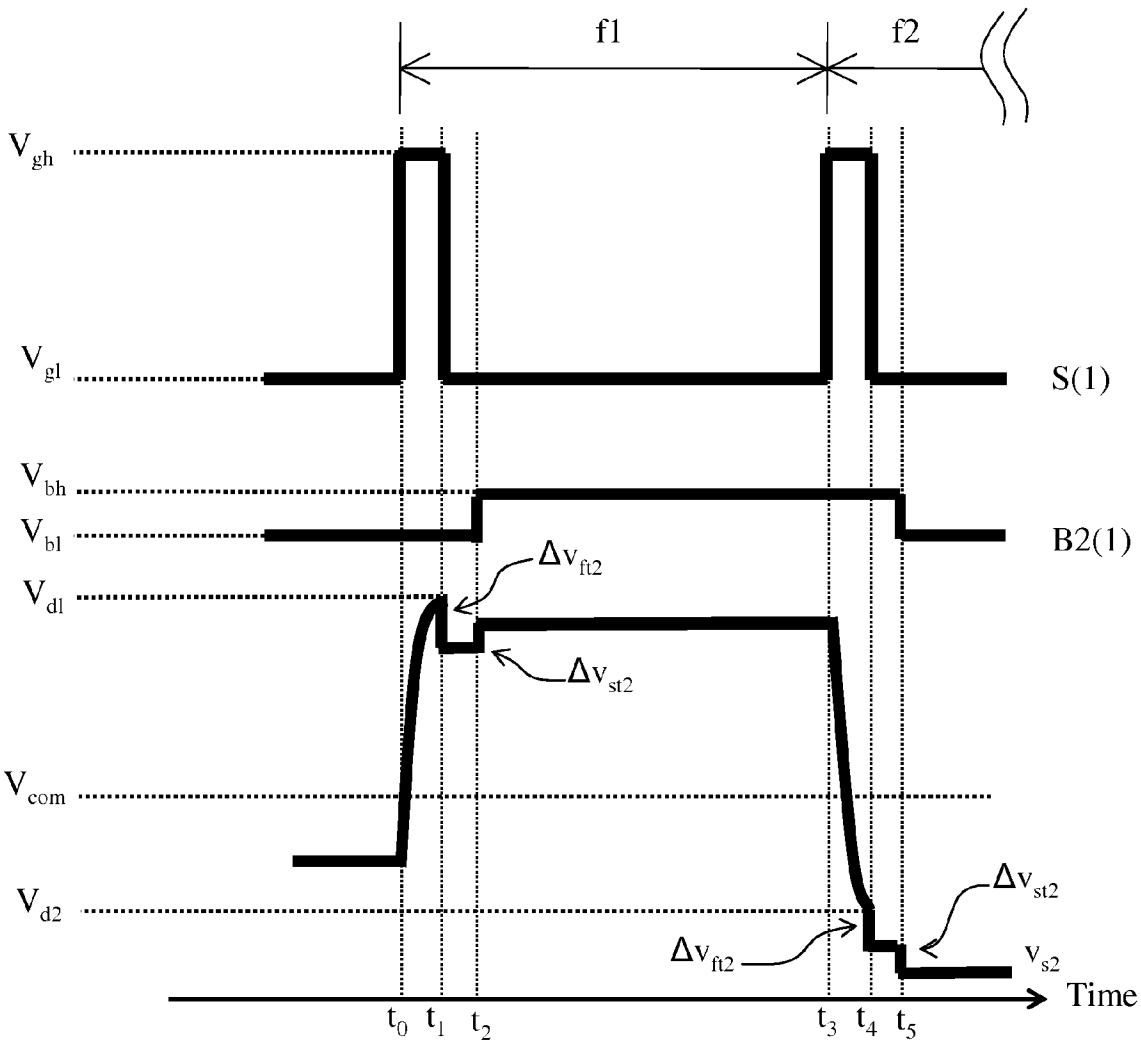

There are many methods of enabling the first sub-pixel and the second sub-pixel to generate different pixel voltages, and only two examples are illustrated in connection with this embodiment. FIGS. 2A and 2B respectively show signal waveforms of the first sub-pixel 1011 and the second sub-pixel 1012 of the LCD panel 100 according to a first driving method. Taking the polarity switching method of dot inversion as an example, in which the polarities of the pixel voltages in adjacent frame time periods of the same pixel are different from each other and the polarities of the pixel voltages of the adjacent pixels are different from each other. As shown in FIGS. 2A and 2B, at time to in the first frame time period f1, the voltage of the first bias line B1(1) is $V_{bh}$, the voltage of the second bias line B2(1) is $V_{bl}$, and the voltage of the scan line S(n) is $V_{gh}$ such that the thin film transistor 10111 and the thin film transistor 10121 turn on. The source driver 102 transmits a display voltage $V_{d1}$ (not shown) to the liquid crystal equivalent capacitor $C_{lc1}$ and the liquid crystal equivalent capacitor $C_{lc2}$ through the data line D(1). Due to the charging effect of the capacitor, the voltage difference $v_{dif1}$ between two terminals of the liquid crystal equivalent capacitor $C_{lc1}$ is slowly changed to $(V_{d1}-V_{com})$, and the voltage difference $v_{dif2}$ between two terminals of the liquid crystal equivalent capacitor $C_{lc2}$ is changed to $(V_{d1}-V_{com})$. At time $t_1$, the voltage of the first bias line B1(1) is still $V_{bh}$, and the voltage of the second bias line B2(1) is still $V_{bl}$. The voltage of the scan line S(n) is $V_{gl}$ such that the thin film transistor 10111 and the thin film transistor 10121 cut off. At this moment, the voltage difference between two terminals of each of the parasitic capacitor $C_{gs1}$ and the parasitic capacitor $C_{gs2}$ has to be kept constant, such that the voltage difference $v_{dif1}$ between two terminals of the liquid crystal equivalent capacitor $C_{lc1}$ is changed from $(V_{d1}-V_{com})$ to $(V_{d1}-V_{com}-\Delta v_{ft1})$, wherein $$\Delta v_{ft1} = (V_{gh} - V_{gl}) \times \frac{C_{gs1}}{C_{gs1} + C_{lc1} + C_{st1}};$$

and the voltage difference $v_{dif2}$ between two terminals of the liquid crystal equivalent capacitor $C_{lc2}$ is changed from $(V_{d1}-V_{com})$ to $$(V_{d1} - V_{com} - \Delta v_{ft2}), \text{ wherein: } \Delta v_{ft2} = (V_{gh} - V_{gl}) \times \frac{C_{gs2}}{C_{gs2} + C_{lc2} + C_{st2}}.$$

This phenomenon is referred to as a feed-through effect. At time $t_2$, the voltage of the first bias line B1(1) is changed from $V_{bh}$ to $V_{bl}$, and the voltage of the second bias line B2(1) is changed from $V_{bl}$ to $V_{bh}$. At this moment, the voltage difference $v_{dif1}$ between two terminals of the liquid crystal equivalent capacitor $C_{lc2}$ is changed from $(V_{d1}-V_{com}-\Delta v_{ft1})$ to $(V_{d1}-V_{com}-\Delta v_{ft1}-\Delta v_{st1})$ due to the feed-through effect, wherein $$\Delta v_{st1} = (V_{bh} - V_{bl}) \times \frac{C_{st1}}{C_{gs1} + C_{lc1} + C_{st1}};$$

and the voltage difference $v_{dif2}$ between two terminals of the liquid crystal equivalent capacitor $C_{lc2}$ is changed to $$(V_{d1} - V_{com} - \Delta v_{ft2} + \Delta v_{st2}),$$

$$\text{wherein: } \Delta v_{st2} = (V_{bh} - V_{bl}) \times \frac{C_{st2}}{C_{gs2} + C_{lc2} + C_{st2}}.$$

At time $t_3$ in the second frame time period f2, the voltage of the first bias line B1(1) is $V_{bl}$, the voltage of the second bias line B2(1) is $V_{bh}$, and the voltage of the scan line S(n) is $V_{gh}$ to make the thin film transistor 10111 and the thin film transistor 10121 turn on. The source driver 102 transfers a display voltage $V_{d2}$ (not shown) to the liquid crystal equivalent capacitor $C_{lc1}$ and the liquid crystal equivalent capacitor $C_{lc2}$ through the data line D(1). The charging effect of the capacitor makes the voltage difference $v_{dif1}$ between two terminals of the liquid crystal equivalent capacitor $C_{lc1}$ change to $(V_{d2}-V_{com})$ slowly, and makes the voltage difference $v_{dif2}$ between two terminals of the liquid crystal equivalent capacitor $C_{lc2}$ to change to $(V_{d2}-V_{com})$. At time $t_4$, the voltage of the first bias line B1(1) is $V_{bl}$, the voltage of the second bias line B2(1) is $V_{bh}$, and the voltage of the scan line S(n) is $V_{gl}$ to make the thin film transistor 10111 and the thin film transistor 10121 cut off. At this moment, because the voltage difference between two terminals of each of the parasitic capacitor $C_{gs1}$, and the parasitic capacitor $C_{gs2}$ has to be kept constant, the voltage difference $v_{dif1}$ between two terminals of the liquid crystal equivalent capacitor $C_{lc1}$ is changed to $(V_{d2}-V_{com}-\Delta v_{ft1})$, and the voltage difference $V_{dif2}$ between two terminals of the liquid crystal equivalent capacitor $C_{lc2}$ is changed to $(V_{d2}-V_{com}-\Delta v_{ft2})$. At time $t_5$, the voltage of the first bias line B1(1) is changed from $V_{bl}$ to $V_{bh}$, and the voltage of the second bias line B2(1) is changed from $V_{bh}$ to $V_{bl}$. At this moment, because the voltage difference between two terminals of each of the storage capacitor $C_{st1}$ and the storage capacitor $C_{st2}$ has to be kept constant, the voltage difference $v_{dif1}$ between two terminals of the liquid crystal equivalent capacitor $C_{lc1}$ is changed to $(V_{d2}-V_{com}-\Delta v_{ft1}+\Delta v_{st1})$, and the voltage difference $v_{dif2}$ between two terminals of the liquid crystal equivalent capacitor $C_{lc2}$ is changed to ($V_{d2}-V_{com}-\Delta v_{ft2}-\Delta v_{st2}$).

In the first frame time period f1, the driving method makes the voltage difference $v_{dif1}$ between two terminals of the liquid crystal equivalent capacitor $C_{lc1}$ of the first sub-pixel 1011 assume a value of ($V_{d1}-V_{com}-\Delta v_{ft1}-\Delta v_{st2}$) and makes the voltage difference $v_{dif2}$ between two terminals of the liquid crystal equivalent capacitor $C_{lc2}$ of the second sub-pixel 1012 assume a value of ($V_{d1}-V_{com}-\Delta v_{ft2}+\Delta v_{st2}$). With this the voltage differences between two terminals of the liquid crystal equivalent capacitors of the first sub-pixel and the second sub-pixel are different from each other and the low color difference effect can be achieved. Similarly, in the second frame time period f2, the driving method causes the voltage difference $v_{dif1}$ between two terminals of the liquid crystal equivalent capacitor $C_{lc1}$ of the first sub-pixel 1011 to become ($V_{d2}-V_{com}-\Delta v_{ft1}+\Delta v_{st1}$) and causes the voltage difference $v_{dif2}$ between two terminals of the liquid crystal equivalent capacitor $C_{lc2}$ of the second sub-pixel 1012 to become ($V_{d1}-V_{com}-\Delta v_{ft2}-\Delta v_{st2}$), such that the voltage differences between two terminals of the liquid crystal equivalent capacitors of the first sub-pixel 1011 and the second sub-pixel 1012 are slightly different from each other and the low color difference effect can be achieved. It is appreciated that, in the first frame time period f1 and the second frame time period f2, the voltage differences between two terminals of the liquid crystal equivalent capacitors of the first sub-pixel 1011 and the second sub-pixel 1012 are kept constant except that the voltage differences change as the capacitors are charged and at B1(1) and B2(1). Thus, the frame stability can be held.

Figure 3A:
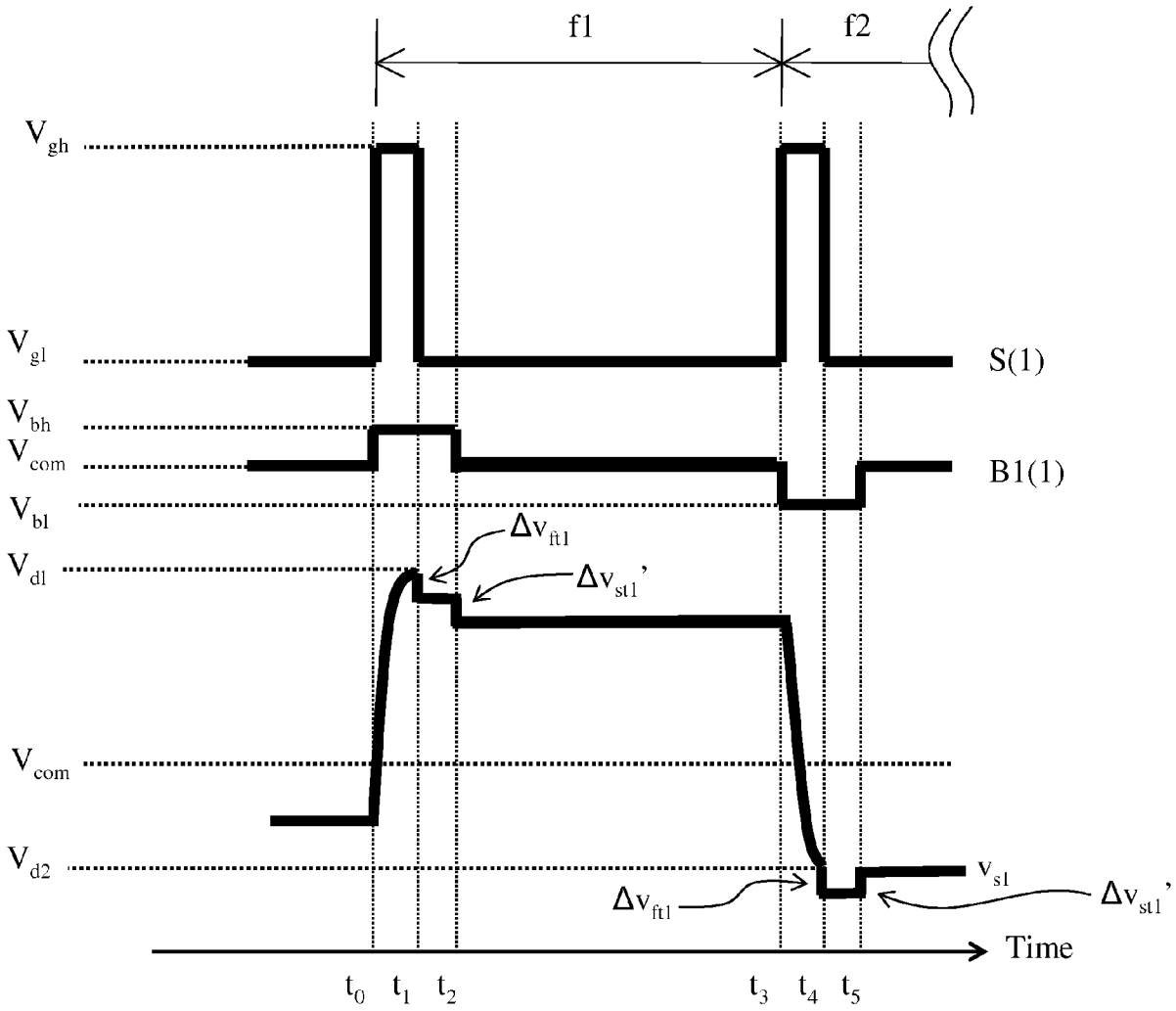
FIGS. 3A and 3B respectively show signal waveforms of the first sub-pixel and the second sub-pixel of the LCD panel according to a second driving method.
Figure 3B:
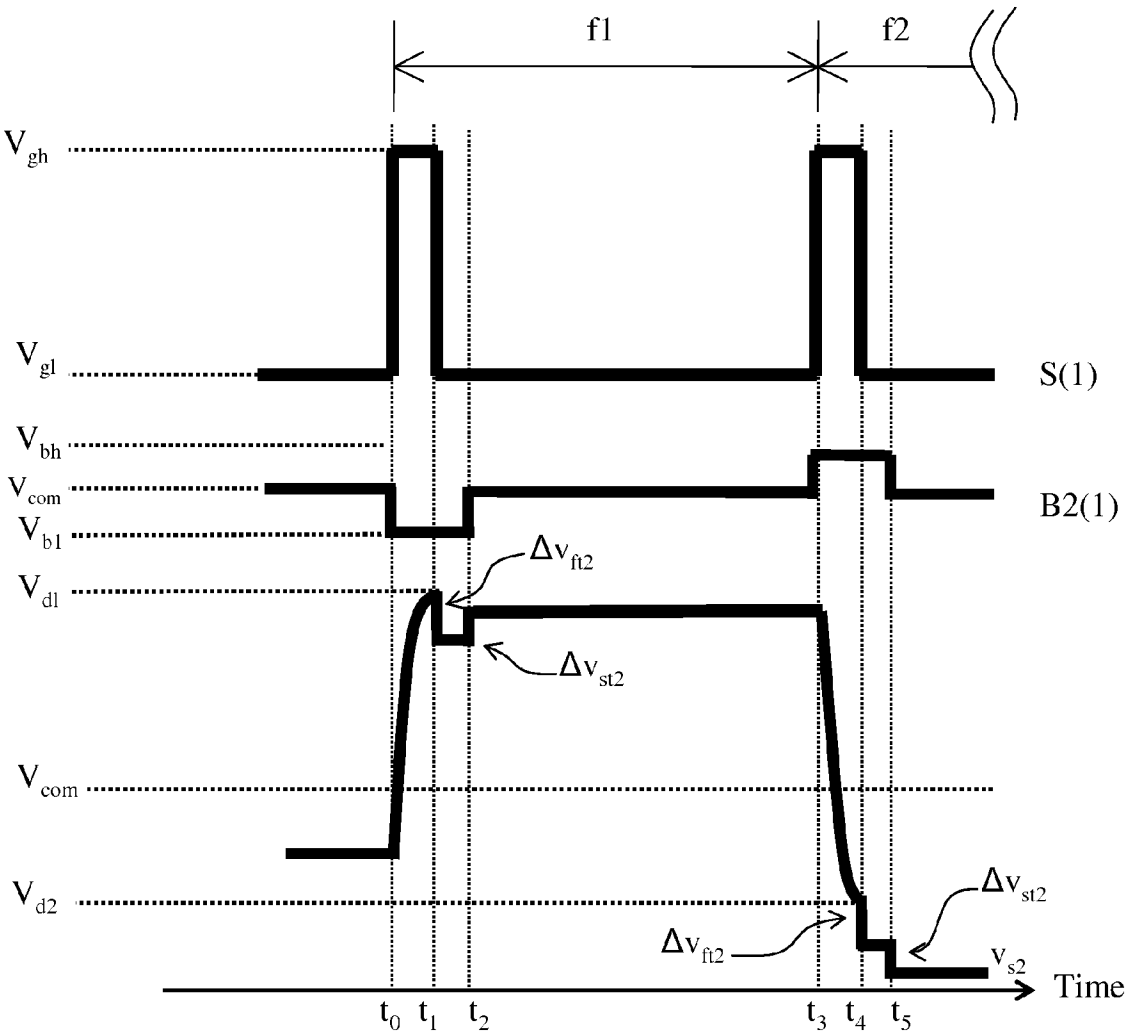

FIGS. 3A and 3B respectively show signal waveforms of the first sub-pixel and the second sub-pixel of the LCD panel 100 according to a second driving method. The second driving method mainly differs from the first driving method as follows: the first driving method only changes the states of the first bias line B1(1) and the second bias line B2(1) after the scan line S is disabled, while the second driving method changes the states of the first bias line B1(1) and the second bias line B2(1) when the scan line S is enabled and after the scan line S is disabled.

At time to in the first frame time period f1, the voltage of the first bias line B1(1) increases from $V_{com}$ to $V_{bh}$, the voltage of the second bias line B2(1) decreases from $V_{com}$ to $V_{bl}$, and the voltage of the scan line S(n) is $V_{gh}$. Thus, the thin film transistor 10111 and the thin film transistor 10121 turn on, and the source driver 102 transfers the display voltage $V_{d1}$ (not shown) to the liquid crystal equivalent capacitor $C_{lc1}$ and the liquid crystal equivalent capacitor $C_{lc2}$ through the data line D(1). The capacitor charging effect enables the voltage difference $v_{dif1}$ between two terminals of the liquid crystal equivalent capacitor $C_{lc1}$ to change to ($V_{d1}-V_{com}$) slowly, and the voltage difference $v_{dif2}$ between two terminals of the liquid crystal equivalent capacitor $C_{lc2}$ to change to ($V_{d1}-V_{com}$) slowly. So, the voltage of the first bias line B1(1) is still $V_{bh}$, the voltage of the second bias line B2(1) is still $V_{bl}$ and the voltage of the scan line S(n) is $V_{gl}$ at time $t_1$, such that the thin film transistor 10111 and the thin film transistor 10121 cut off. At this moment, the voltage difference $v_{dif1}$ between two terminals of liquid crystal equivalent capacitor $C_{lc1}$ is changed from ($V_{d1}-V_{com}$) to ($V_{d1}-V_{com}-\Delta v_{ft1}$) due to the feed-through effect, wherein $$\Delta v_{ft1} = (V_{gh} - V_{gl}) \times \frac{C_{gs1}}{C_{gs1} + C_{lc1} + C_{st1}};$$

and the voltage difference $v_{dif2}$ between two terminals of the liquid crystal equivalent capacitor $C_{lc2}$ is changed from ($V_{d1}-V_{com}$) to ($V_{d1}-V_{com}-\Delta v_{ft2}$), wherein $$\Delta v_{ft2} = (V_{gh} - V_{gl}) \times \frac{C_{gs2}}{C_{gs2} + C_{lc2} + C_{st2}}.$$

Later, at time $t_2$, the voltage of the first bias line B1(1) decreases from $V_{bh}$ to $V_{com}$, the voltage of the second bias line B2(1) increases from $V_{bl}$ to $V_{com}$. At this moment, due to the feed-through effect, the voltage difference $v_{dif1}$ between two terminals of liquid crystal equivalent capacitor $C_{lc2}$ is changed from ($V_{d1}-V_{com}-\Delta v_{ft1}$) to ($V_{d1}-V_{com}-\Delta v_{ft1}-\Delta v_{st1}'$), wherein $$\Delta v'_{st1} = (V_{bh} - V_{com}) \times \frac{C_{st1}}{C_{gs1} + C_{lc1} + C_{st1}};$$

and the voltage difference $v_{dif2}$ between two terminals of the liquid crystal equivalent capacitor $C_{lc2}$ is changed to ($V_{d1}-V_{com}-\Delta v_{ft2}+\Delta v_{st2}'$), wherein $$\Delta v'_{st2} = (V_{com} - V_{bl}) \times \frac{C_{st2}}{C_{gs2} + C_{lc2} + C_{st2}}.$$

At time $t_3$ in the second frame time period f2, the voltage of the first bias line B1(1) decreases from $V_{com}$ to $V_{bl}$, the voltage of the second bias line B2(1) increases from $V_{com}$ to $V_{bh}$, and the voltage of the scan line S(n) is $V_{gh}$ such that the thin film transistor 10111 and the thin film transistor 10121 turn on. The source driver 102 transfers the display voltage $V_{d2}$ (not shown) to the liquid crystal equivalent capacitor $C_{lc1}$ and the liquid crystal equivalent capacitor $C_{lc2}$ through the data line D(1). Due to the capacitor charging effect, the voltage difference $v_{dif1}$ between two terminals of the liquid crystal equivalent capacitor $C_{lc1}$ is changed to ($V_{d2}-V_{com}$) slowly, and the voltage difference $v_{dif2}$ between two terminals of the liquid crystal equivalent capacitor $C_{lc2}$ is changed to ($V_{d2}-V_{com}$) slowly. At time $t_4$, the voltage of the first bias line B1(1) is still $V_{bl}$, the voltage of the second bias line B2(1) is still $V_{bh}$ and the voltage of the scan line S (n) is still $V_{gl}$ such that the thin film transistor 10111 and the thin film transistor 10121 cut off. At this moment, due to the feed-through effect, the voltage difference $V_{dif1}$ between two terminals of the liquid crystal equivalent capacitor $C_{lc1}$ is changed to ($V_{d2}-V_{com}-\Delta v_{ft1}$), and the voltage difference $v_{dif2}$ between two terminals of the liquid crystal equivalent capacitor $C_{lc2}$ is changed to ($V_{d2}-V_{com}-\Delta v_{ft2}$). Later, at time $t_5$, the voltage of the first bias line B1(1) increases from $V_{bl}$ to $V_{com}$, the voltage of the second bias line B2(1) decreases from $V_{bh}$ to $V_{com}$. At this moment, due to the feed-through effect, the voltage difference $v_{dif1}$ between two terminals of the liquid crystal equivalent capacitor $C_{lc1}$ is changed to ($V_{d2}-V_{com}-\Delta v_{ft1}+\Delta v_{st1}'$), and the voltage difference $v_{dif2}$ between two terminals of the liquid crystal equivalent capacitor $C_{lc2}$ is changed to ($V_{d2}-V_{com}-\Delta v_{ft2}-\Delta v_{st2}'$).

The first and second driving methods assume the phase difference of 180 degrees between the levels of the first bias line B1(1) and the second bias line B2(1), so the voltage differences between two terminals of the liquid crystal equivalent capacitors of the first sub-pixel 1011 and the second sub-pixel 1012 are slightly different from each other, and the low color difference effect can be achieved.

In addition to the 180 degrees of this embodiment, the phase difference between the first bias line B1(1) and the second bias line B2(1) may also range from 180 to 360 degrees. In addition, in one frame time period, the number of switching time(s) of the first bias line B1(1) and the second bias line B2(1) is one in this embodiment but may be two or more than two in other embodiments.

It is appreciated that, in the first frame time period f1 and the second frame time period f2, the voltage differences between two terminals of the liquid crystal equivalent capacitors of the first sub-pixel 1011 and the second sub-pixel 1012 are kept constant except that the voltage differences change as the capacitors are charged. Thus, the frame stability can be held.

Second Embodiment

Figure 4:
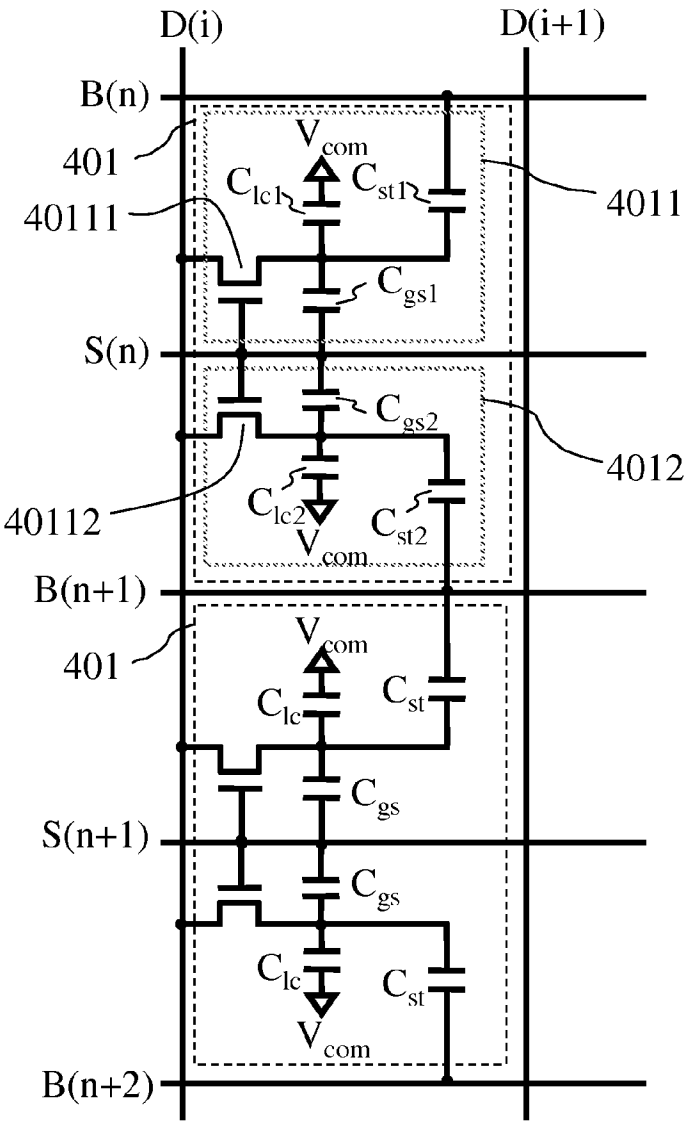
FIG. 4 shows an equivalent circuit diagram of a multi-domain LCD panel according to a second embodiment of the invention.

FIG. 4 shows an equivalent circuit diagram of a multi-domain LCD panel according to a second embodiment of the invention. Referring to FIG. 4, the LCD panel 400 includes a plurality of pixels 401 arranged in a matrix, a plurality of parallel bias lines B, a plurality of parallel scan lines S and a plurality of parallel data lines D, wherein the bias lines B and the scan lines S are alternately arranged in parallel and perpendicular to the data lines D. The pixel 401 includes a corresponding data line D, a corresponding scan line S and a corresponding bias line B.

The pixel 401 includes a first sub-pixel 4011 and a second sub-pixel 4012. The first sub-pixel 4011 includes a thin film transistor 40111, a liquid crystal equivalent capacitor $C_{lc1}$ and a storage capacitor $C_{st1}$. The second sub-pixel 4012 includes a thin film transistor 40121, a liquid crystal equivalent capacitor $C_{lc2}$ and a storage capacitor $C_{st2}$.

The difference between the LCD panel 400 of the second embodiment and the LCD panel 100 of the first embodiment will be described in the following. Two adjacent bias lines B are merged into one bias line in the LCD panel 400. That is, one bias line B of the LCD panel 400 simultaneously adjusts the second sub-pixel of an upper pixel and the first sub-pixel of a lower pixel. Thus, the number of the bias lines may be reduced to one half. The phases of the voltages of the adjacent bias line B(n) and bias line B(n+1) are different from each other.

Figure 5A:
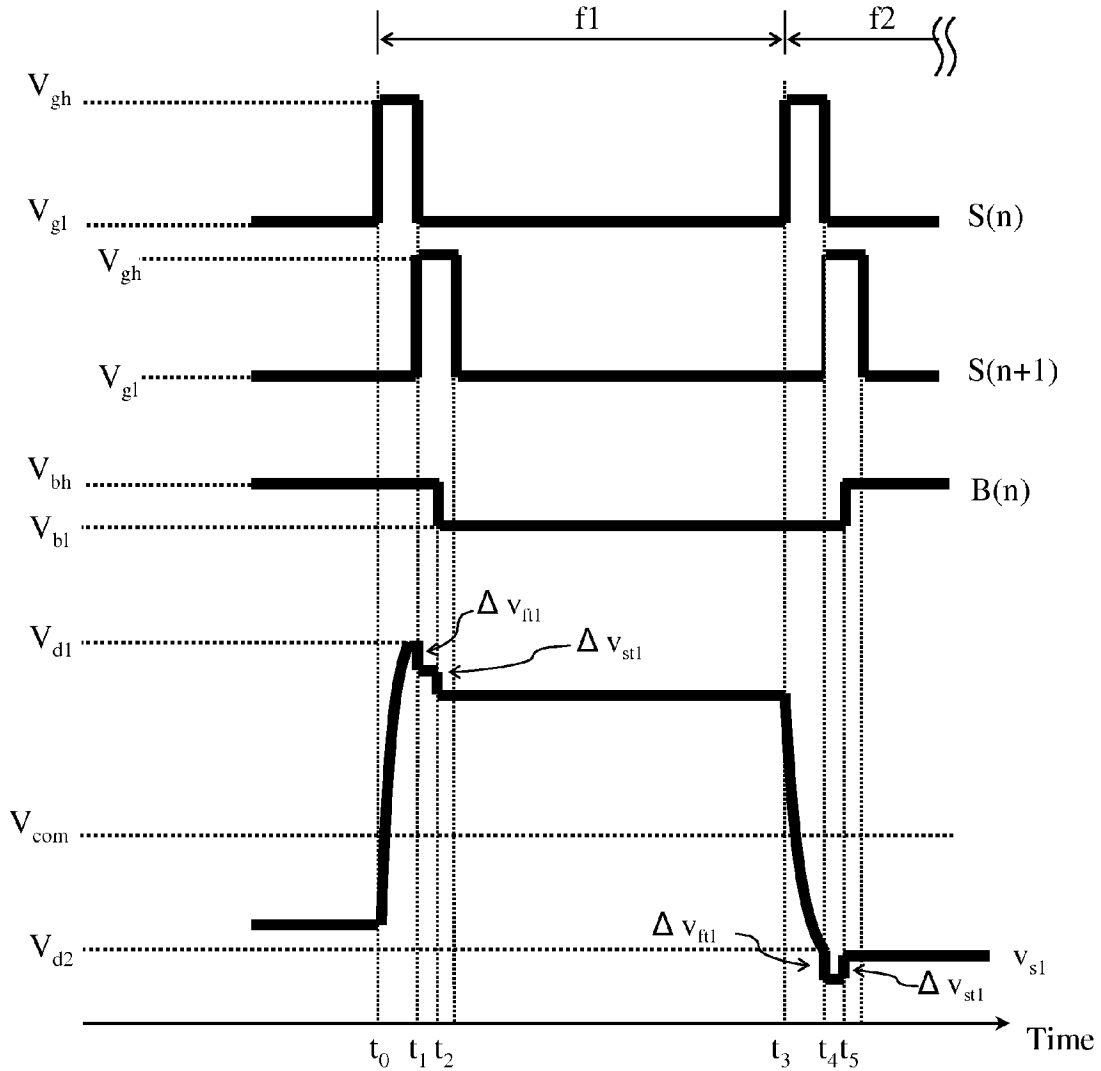
FIGS. 5A and 5B respectively show signal waveforms of the first sub-pixel and the second sub-pixel of the LCD panel according to a third driving method.
Figure 5B:
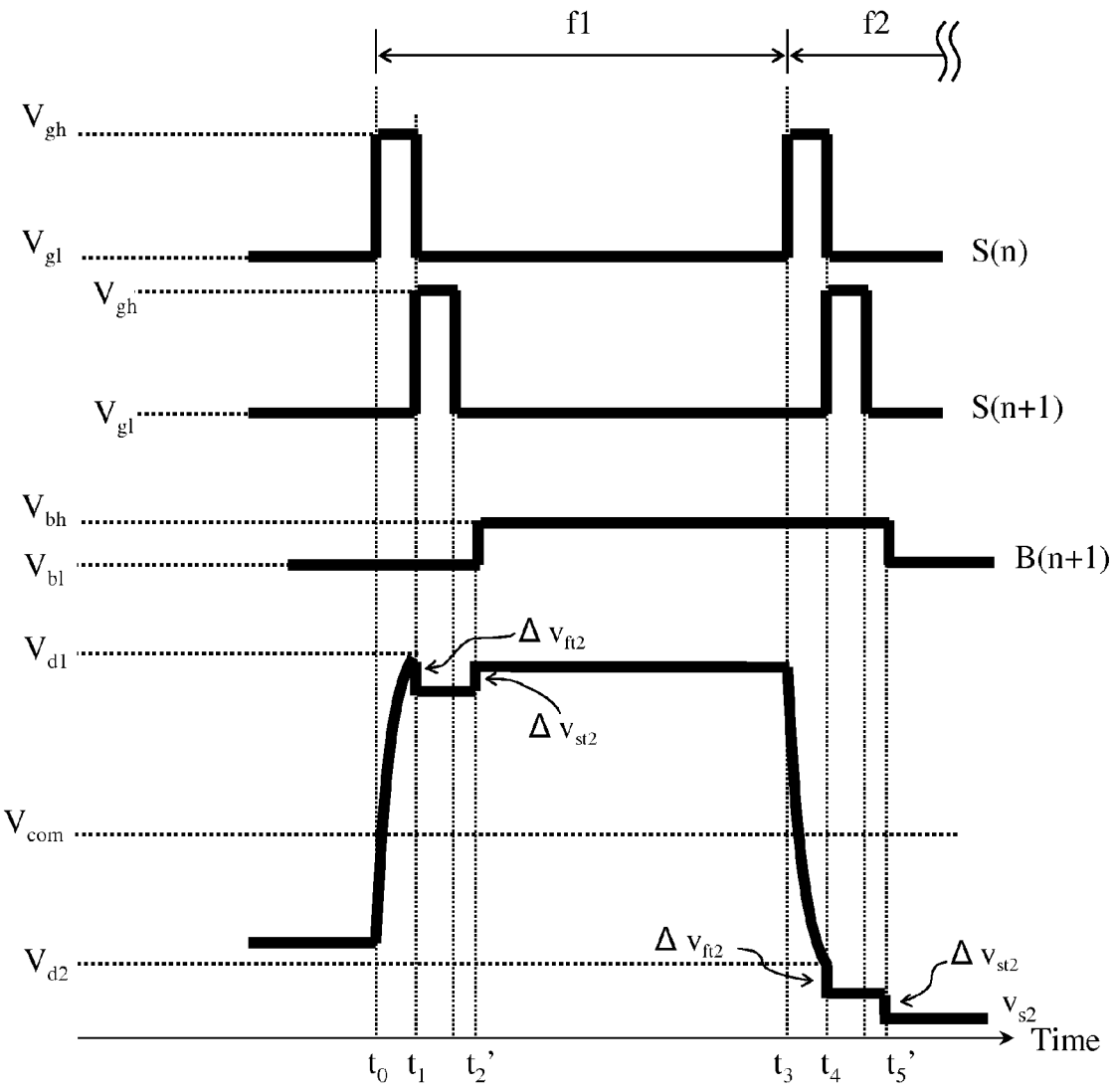

FIGS. 5A and 5B respectively show signal waveforms of the first sub-pixel and the second sub-pixel of the LCD panel 400 according to a third driving method. The signal waveform (FIG. 5A) for driving the first sub-pixel 4011 according to the third driving method is the same as the signal waveform (FIG. 2A) for driving the first sub-pixel 1011 according to the first driving method of the first embodiment, and detailed descriptions thereof will be omitted.

The difference between the signal waveform (FIG. 5B) for driving the second sub-pixel 4012 of the LCD panel 400 according to the third driving method and that (FIG. 2B) for driving the second sub-pixel 1012 of the LCD panel 100 according to the first driving method of the first embodiment resides in the signal of the bias line B. At time $t_0$ in the first frame time period f1, the voltage of the bias line B(n+1) is $V_{bl}$ and the voltage of the scan line S(n) is $V_{gh}$ such that the thin film transistor 40111 and the thin film transistor 40121 turn on. At time $t_1$, the voltage of the bias line B(n+1) is still $V_{bl}$ and the voltage of the scan line S(n) is decreased to $V_{gl}$ such that the thin film transistor 40111 and the thin film transistor 40121 cut off. It is appreciated that the disabled scan line S(n) cannot directly and immediately increase the voltage of the bias line B2, as shown in FIG. 2B because the bias line B(n+1) still has to adjust the first sub-pixel of the lower pixel. Thus, the voltage of the bias line B(n+1) cannot be increased from $V_{bl}$ to $V_{bh}$ until the scan line S(n+1) of the lower pixel is enabled and disabled at time $t_2'$.

At time $t_3$ in the second frame time period f2, the voltage of the bias line B(n+1) is $V_{bh}$ and the voltage of the scan line S(n) is $V_{gh}$ such that the thin film transistor 40111 and the thin film transistor 40121 turn on. At time $t_4$, the voltage of the bias line B(n+1) is still $V_{bh}$ and the voltage of the scan line S(n) is decreased to $V_{gl}$ such that the thin film transistor 40111 and the thin film transistor 40121 cut off. It will be appreciated that the disabled scan line S(n) cannot directly and immediately reduce the voltage of the bias line B, as shown in FIG. 2B, because the bias line B(n+1) still has to adjust the first sub-pixel of the lower pixel. Thus, after the scan line S(n+1) of the lower pixel being disabled before time t5', the voltage of the bias line B(n+1) is reduced from $V_{bh}$ to $V_{bl}$ at time t5'.

Figure 6A:
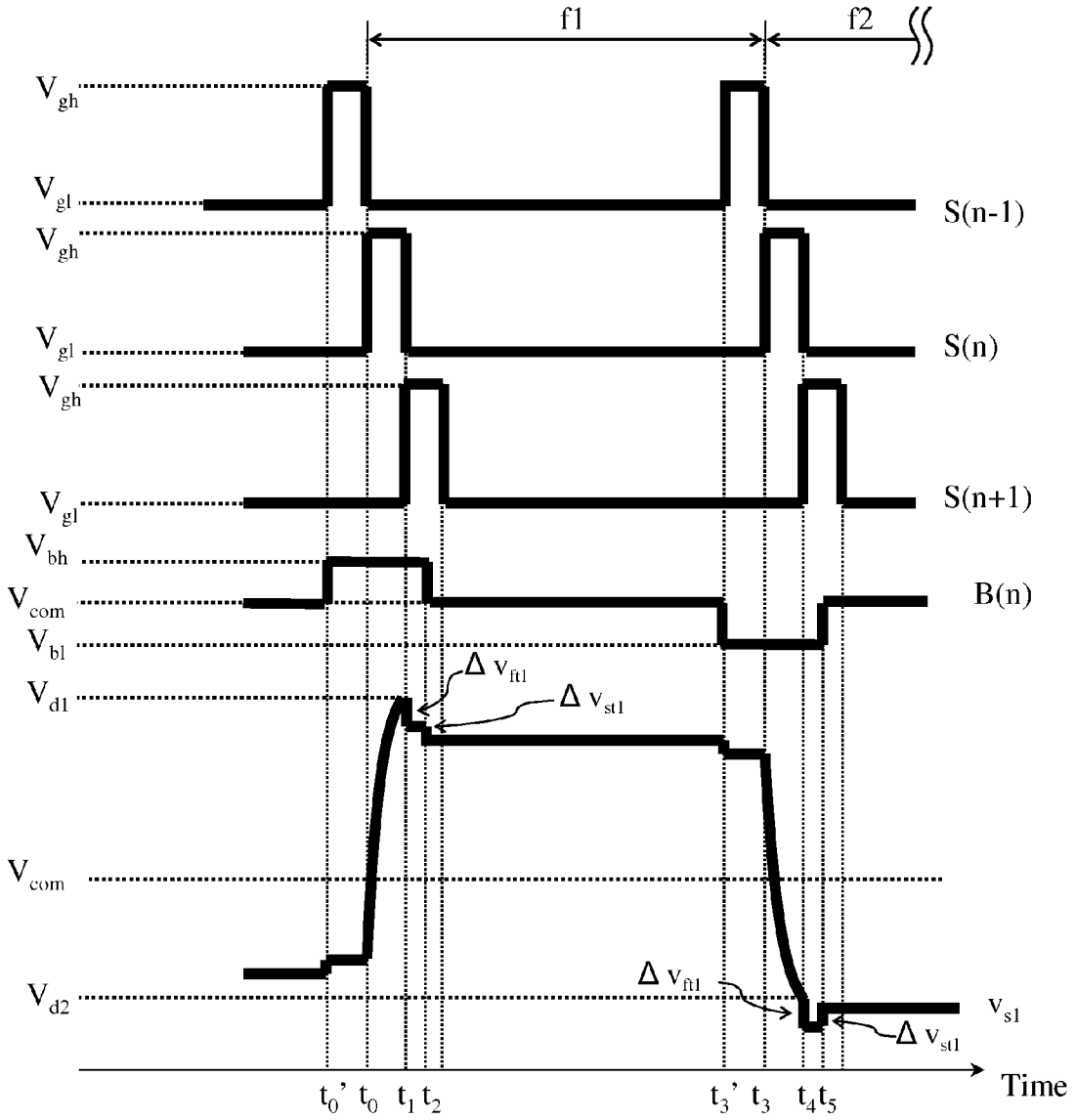
FIGS. 6A and 6B respectively show signal waveforms of the first sub-pixel and the second sub-pixel of the LCD panel 400 according to a fourth driving method.
Figure 6B:
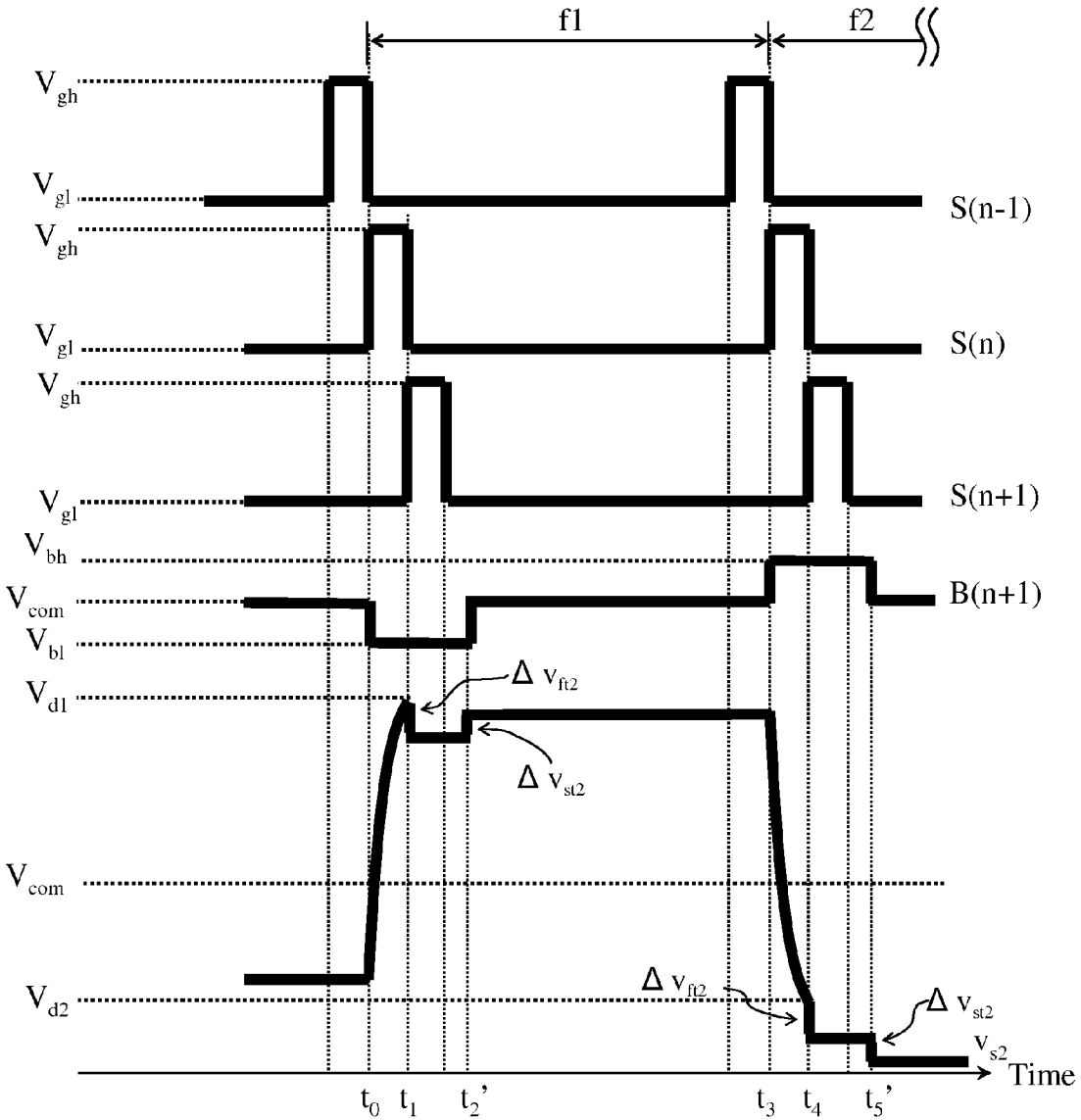

FIGS. 6A and 6B respectively show signal waveforms of the first sub-pixel and the second sub-pixel of the LCD panel 400 according to a fourth driving method. In the first frame time period f1, the voltage on the bias line B(n) has to be changed from $V_{com}$ to $V_{bh}$ at the time $t_0'$ when the scan line S(n−1) is enabled because the bias line B(n) still has to adjust the second sub-pixel of the upper pixel. After the scan line S(n) is disabled, the voltage on the bias line B(n) is changed from $V_{com}$ to $V_{bl}$ at time $t_2$; and the voltage on the bias line B(n+1) is changed from $V_{com}$ to $V_{bl}$ at the time $t_0$. However, the voltage on the bias line B(n+1) cannot be changed from $V_{bl}$ to $V_{com}$ until the scan line S(n+1) is disabled at time $t_2'$ because the bias line B(n+1) still has to adjust the first sub-pixel of the lower pixel. In the second frame time period f2, because the bias line B(n) still has to adjust the second sub-pixel of the upper pixel, the voltage on the bias line B(n) has to be changed from $V_{com}$ to $V_{bl}$ at the time $t_3'$ when the scan line S(n−1) is enabled. After the scan line S(n) is disabled, the voltage on the bias line B(n) is changed from $V_{bl}$ to $V_{com}$ at time $t_5$. The voltage on the bias line B(n+1) is changed from $V_{com}$ to $V_{bh}$ at time $t_3$. However, the bias line B(n+1) still has to adjust the first sub-pixel of the lower pixel. Thus, the voltage on the bias line B(n+1) cannot be changed from $V_{bh}$ to $V_{com}$ at time $t_5'$ after the scan line S(n+1) is disabled.

Method of Driving Bias Lines

Figure 7A:
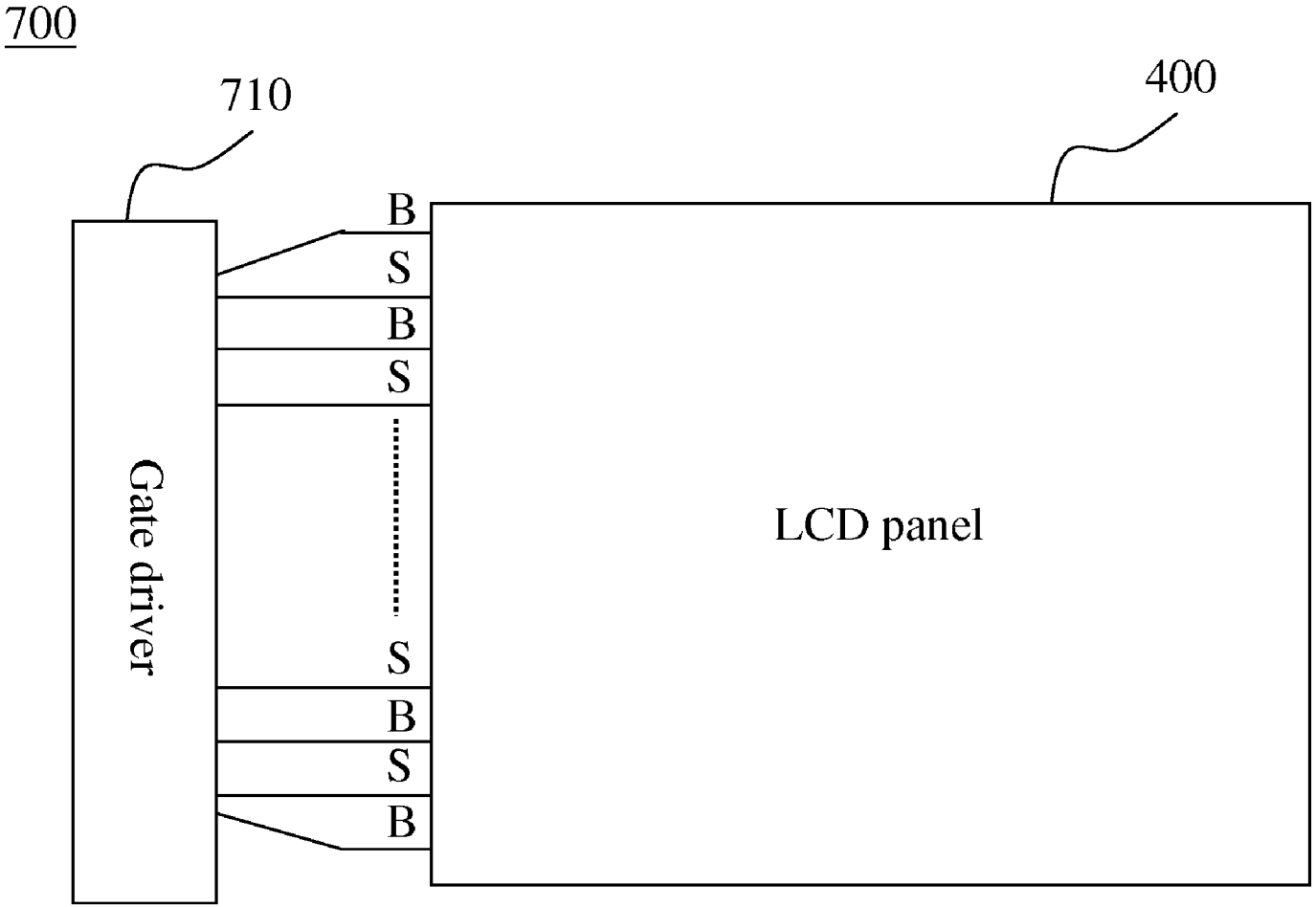
FIGS. 7A to 7D are schematic illustrations showing a LCD having a gate driver for driving bias lines.

The bias lines may be driven by a gate driver or a logic circuit in this example. However, one of ordinary skill in the art may achieve the driving method of the invention according to any other arbitrary device or method. FIGS. 7A to 7D are schematic illustrations showing a LCD having a gate driver for driving bias lines. FIG. 7A is a schematic illustration showing a first LCD 700 having a gate driver for driving the bias lines, wherein the LCD panel 400 serves as an example. The LCD 700 includes the LCD panel 400 and at least one gate driver 710. Output levels of pins of the gate driver 710 may be respectively set, and the pins may be electrically connected to the corresponding scan lines S or bias lines B such that the pins respectively output the levels for the scan signals S and the bias lines B.

Figure 7B:
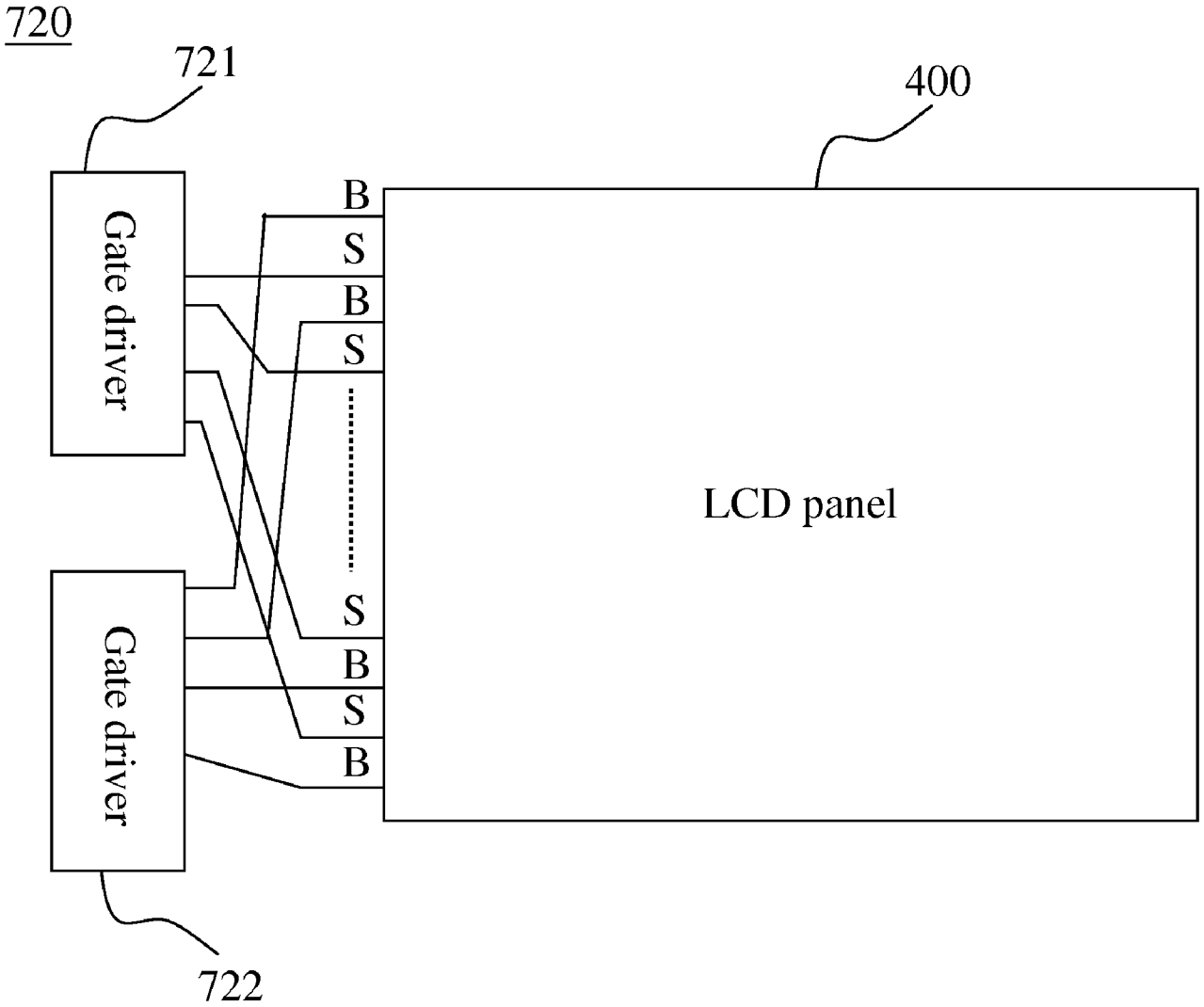

FIG. 7B is a schematic illustration showing a second LCD 720 having a gate driver for driving the bias lines. The LCD 720 includes the LCD panel 400 and gate drivers 721 and 722. The gate driver 721 generates the scan signal S, and the gate driver 722 generates the level for the bias line B.

Figure 7C:
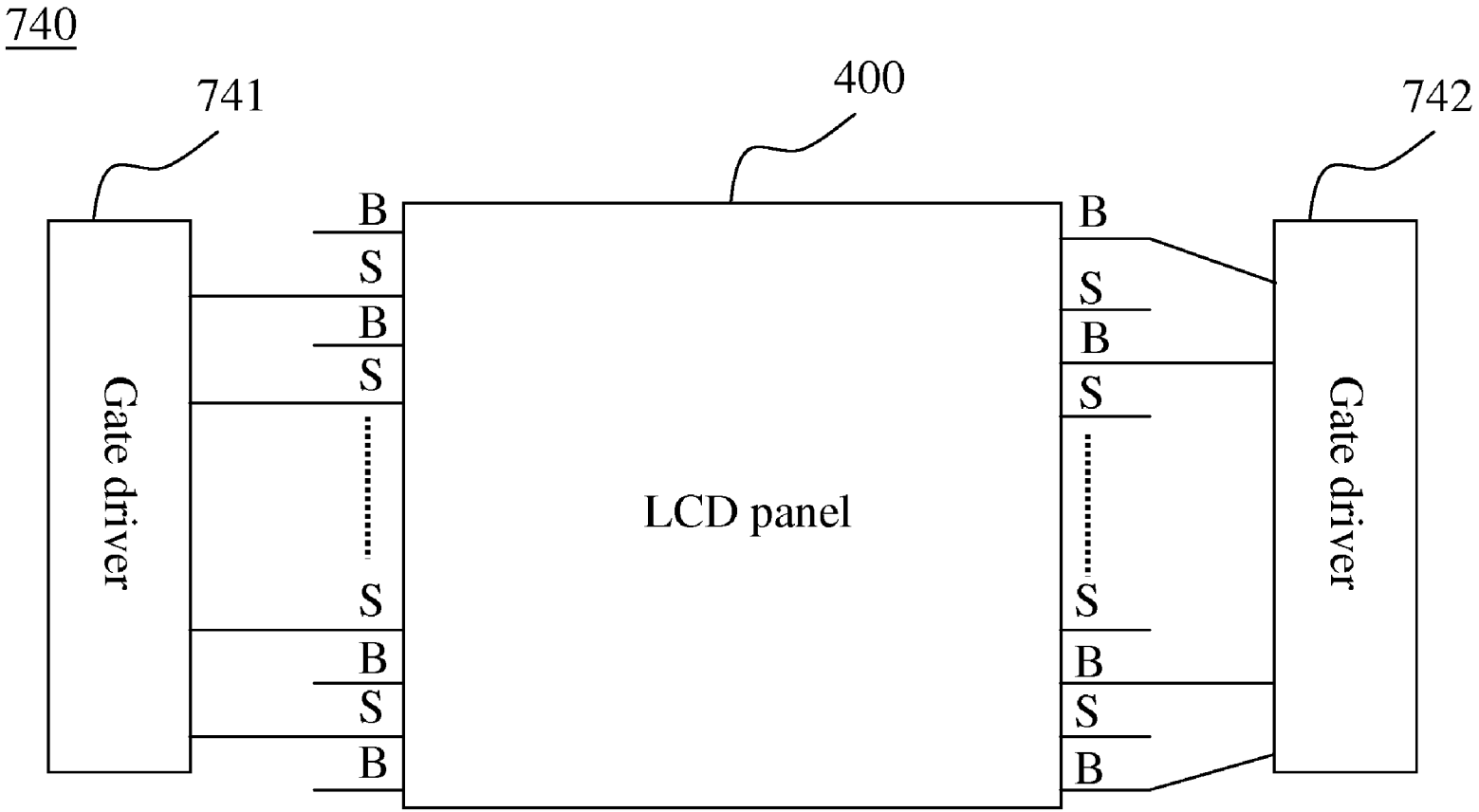

FIG. 7C is a schematic illustration showing a third LCD 740 having a gate driver for driving the bias lines. The LCD 740 includes the LCD panel 400 and gate drivers 741 and 742. What is different from the LCD 720 is that the gate driver 742 drives the bias line B from the second terminal of the panel.

Figure 7D:
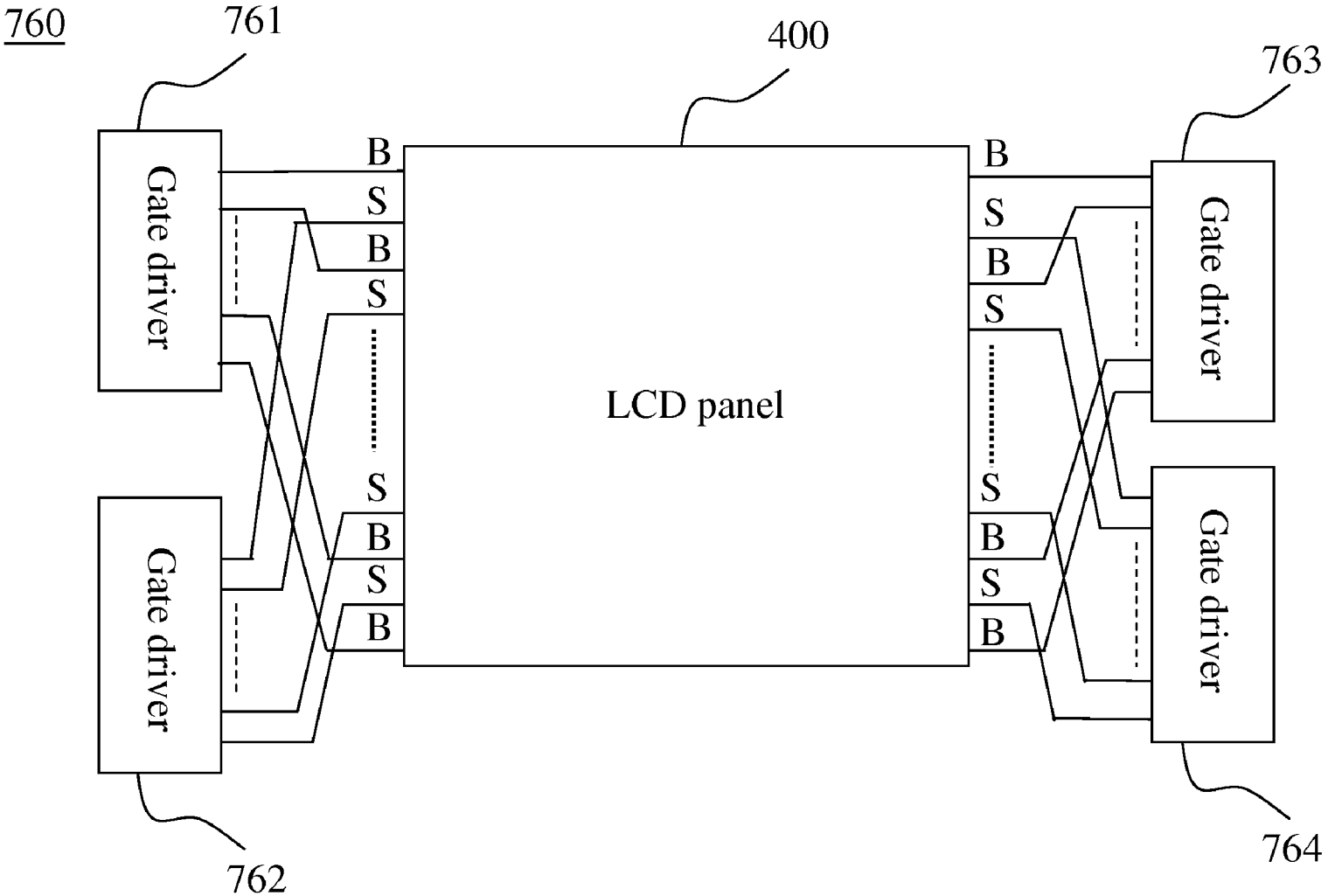

FIG. 7D is a schematic illustration showing a fourth LCD 760 having a gate driver for driving the bias lines. The LCD 760 includes the LCD panel 400 and gate drivers 761, 762, 763 and 764. The gate drivers 761 and 763 commonly drive the bias line B respectively from two ends of the LCD panel 400, and the gate drivers 762 and 764 commonly drives the scan line S respectively from the two ends of the LCD panel 400.

Figure 8:
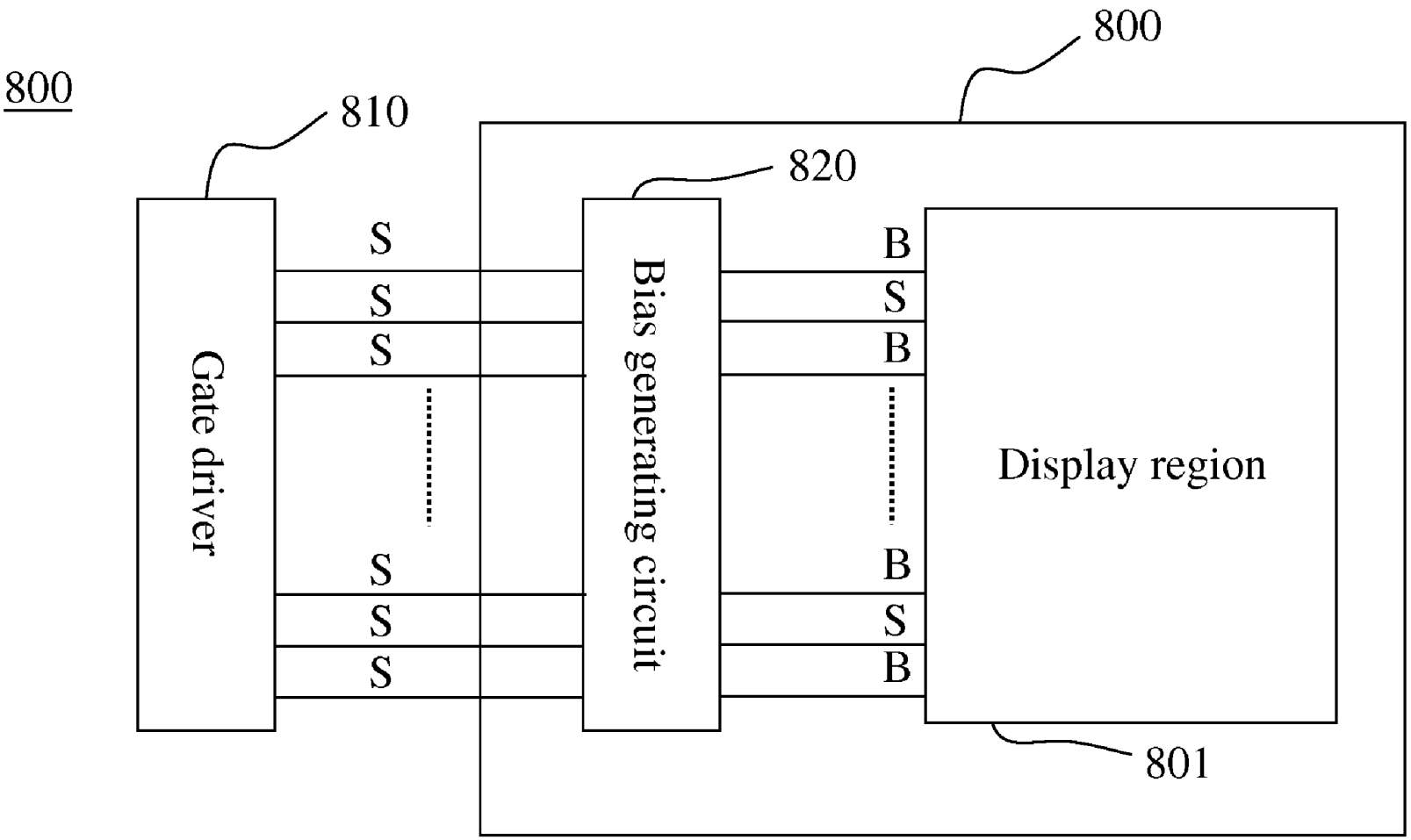
FIG. 8 is a schematic illustration showing a first LCD having a logic circuit for driving the bias lines.

Hereinafter, a LCD using a logic circuit to drive the bias lines will be described. FIG. 8 is a schematic illustration showing a first LCD 800 having a logic circuit for driving the bias lines. The LCD 800 includes a gate driver 810, a bias generating circuit 820 and the LCD panel 400. The bias generating circuit 820 is formed on a glass substrate of the LCD panel 400. The gate driver 810 drives the scan line S. The bias generating circuit 820 drives the bias line B according to the scan line S. The bias generating circuit 820 includes a plurality of bias units, each of which generates a voltage level for the bias line according to two adjacent scan lines corresponding to the bias line. The bias unit 822 may be implemented in many ways. Four ways will be illustrated in this embodiment, as shown in FIGS. 9A, 10A, 11A and 12A. However, one of ordinary skill in the art will easily understand that the voltage level for the bias line of the invention may be generated using any other devices or methods.

Figure 9A:
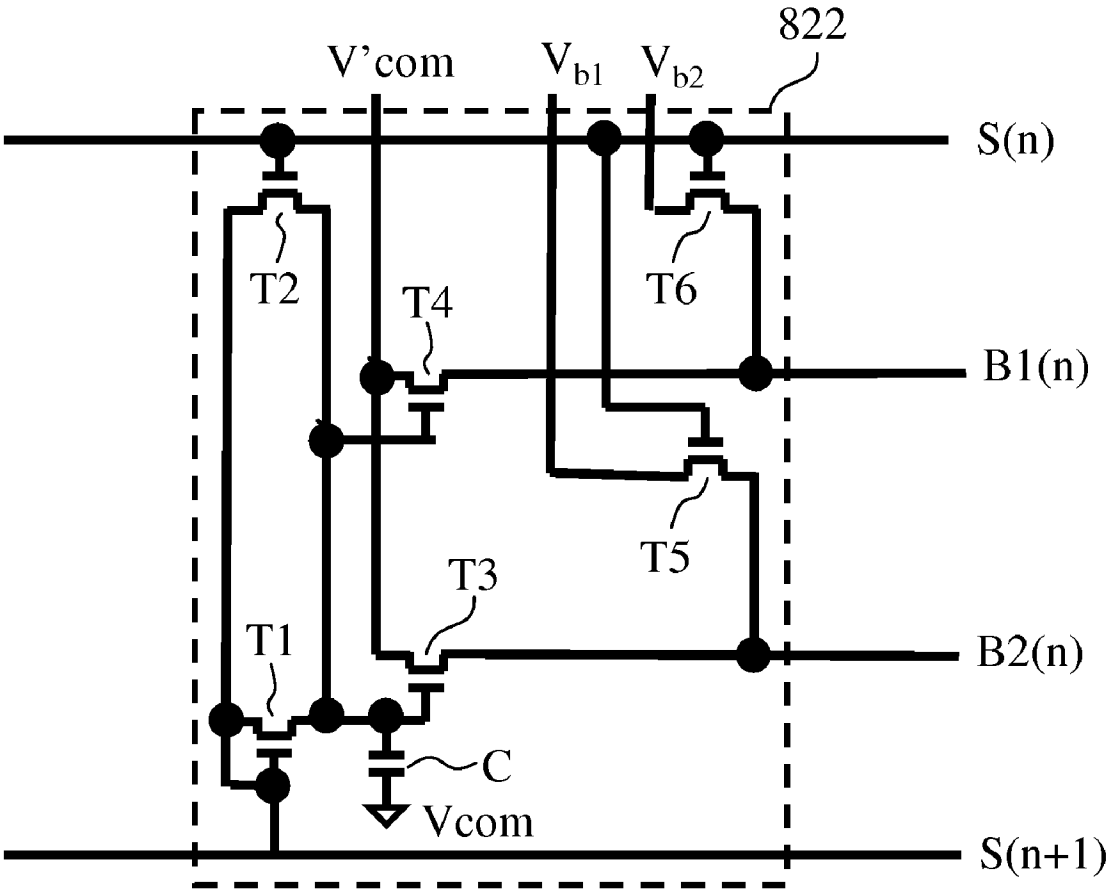
FIGS. 9A, 10A, 11A and 12A respectively show circuit diagrams of bias units.
Figure 9B:
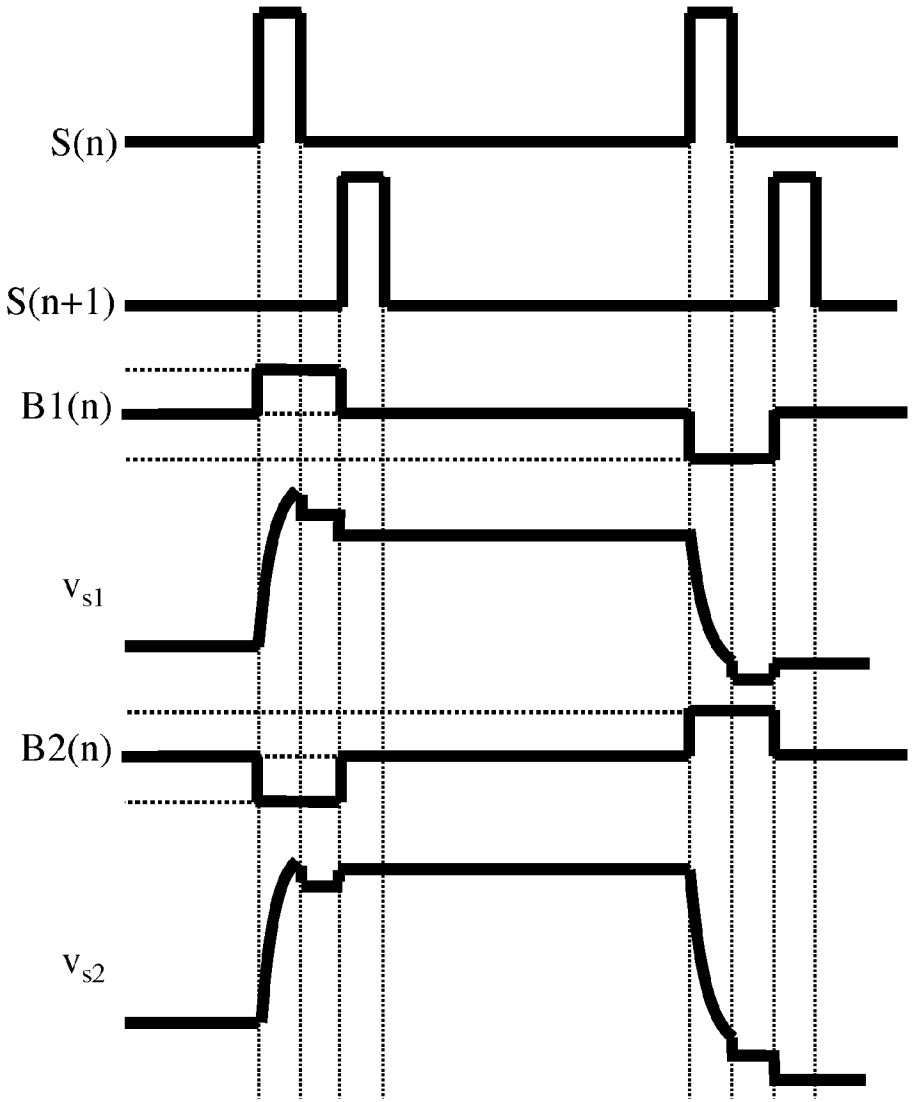
FIGS. 9B, 10B, 11B and 12B respectively show signal waveforms of various bias units and the corresponding first sub-pixel and the second sub-pixel.

FIG. 9A is a circuit diagram showing the first bias unit 822 configured to be electrically connected to the scan lines S(n) and S(n+1) in this example. The bias unit 822 includes thin film transistors T1 to T6 and a capacitor C. Please refer also to FIG. 9B, which shows signal waveforms of the bias unit 822 and its corresponding first sub-pixel and second sub-pixel. In the first frame time period f1, the scan line S(n) is enabled such that the transistors T2, T5, T6 turn on. So, the levels on the bias lines B1(n) and B2(n) are respectively changed to the levels of $V_{b1}$ and $V_{b2}$. After the scan line S(n) is disabled and when the scan line S(n+1) is enabled, the transistors T2, T5, T6 turn off, and the transistors T1, T3 and T4 turn on. Thus, the levels on the bias lines B1(n) and B2(n) are changed to $V'_{com}$, which may also be the voltage $V_{com}$ of the common electrode.

If the polarity switching method by dot inversion is utilized, the polarities of the voltages $V_{b1}$ and $V_{b2}$ have to be changed with the switching of each frame. In addition, one of the voltages $V_{b1}$ and $V_{b2}$ may be set to be equal to the voltage $V'_{com}$. The transistors T3 and T5 may be eliminated if the voltage $V_{b1}$ is equal to $V'_{com}$, and the transistors T4 and T6 may be eliminated if the voltage $V_{b2}$ is equal to $V'_{com}$.

Figure 10A:
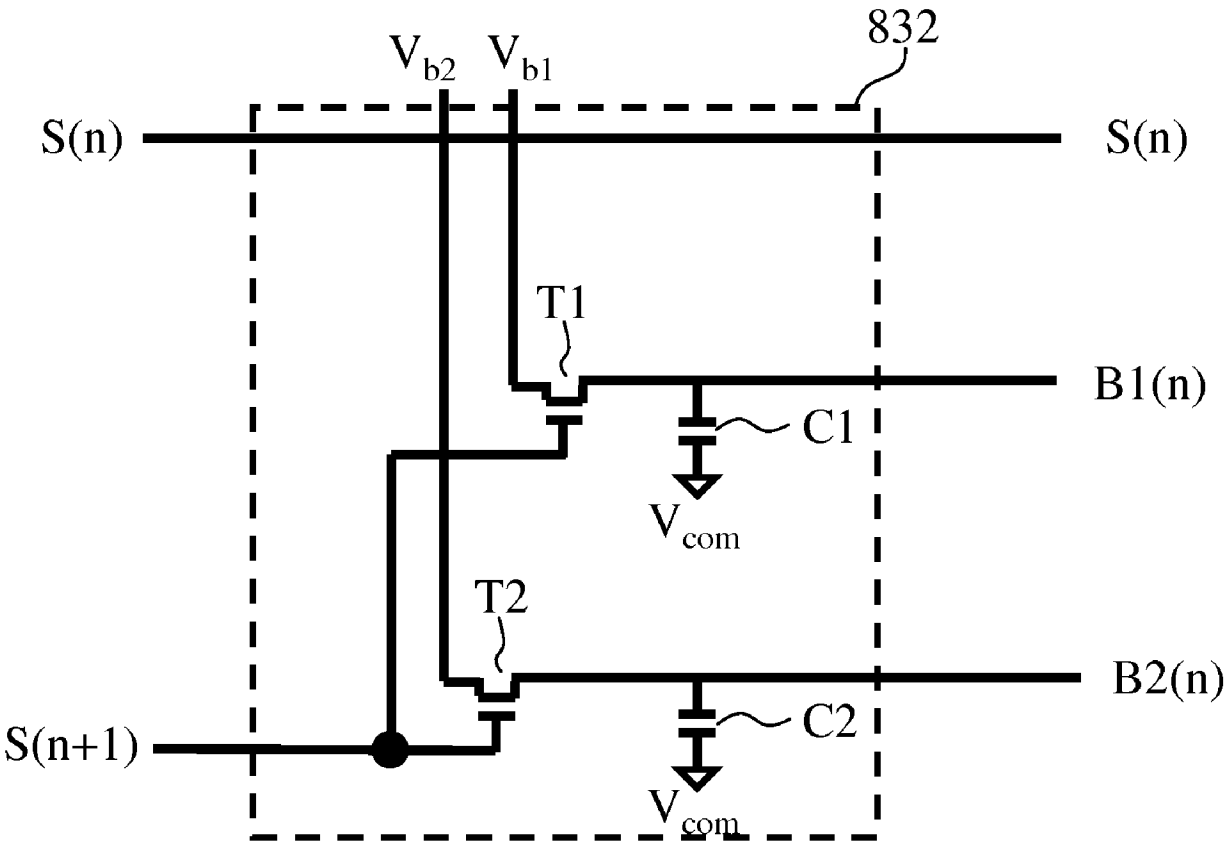
Figure 10B:
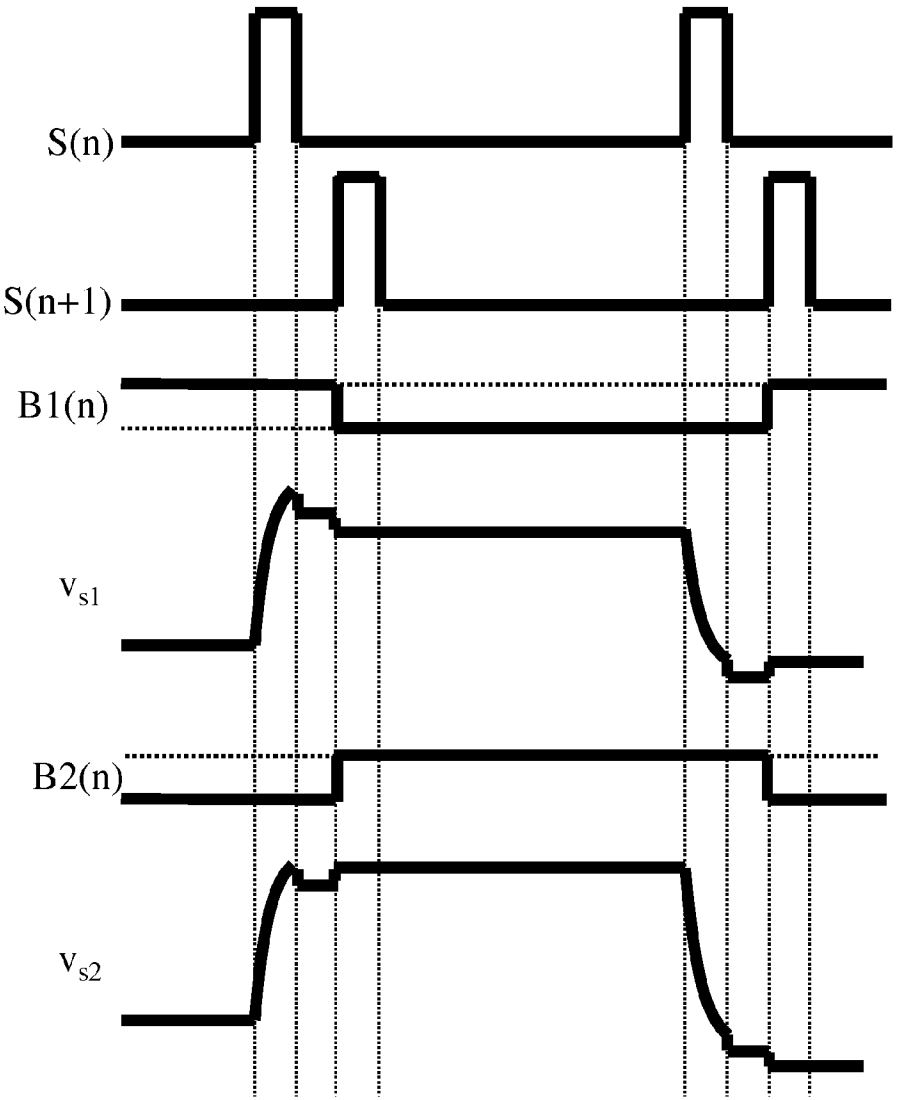

FIG. 10A is a circuit diagram showing a second bias unit 832, which is to be electrically connected to the scan lines S(n) and S(n+1) in this example. The bias unit 832 includes thin film transistors T1 and T2 and capacitors C1 and C2. Please also refer to FIG. 10B, which shows signal waveforms of the bias unit 832 and its corresponding first sub-pixel and second sub-pixel. In the first frame time period f1, the scan line S(n) is enabled and the transistors T1 and T2 turn off, so the levels of the bias lines B1(n) and B2(n) are the levels of $V_{b1}$ and $V_{b2}$ in the previous frame time period f0. When the scan line S(n+1) is enabled, the transistors T1 and T2 turn on. Thus, the levels on the bias lines B1(n) and B2(n) are respectively changed to $V_{b1}$ and $V_{b2}$ in the first frame time period f1.

If the polarity switching method by dot inversion is utilized, the polarities of the voltages $V_{b1}$ and $V_{b2}$ have to be switched with the switching of each frame. The polarity of $V_{b1}$ in the previous frame time period f0 is different from that of $V_{b1}$ in the first frame time period f1; and the polarity of $V_{b2}$ in the previous frame time period f0 is different from that of $V_{b2}$ in the first frame time period f1. In addition, one of the voltages $V_{b1}$ and $V_{b2}$ may be set to be equal to the voltage $V_{com}$. If the voltage $V_{b1}$ is equal to $V_{com}$, the transistor T1 and the capacitor C1 may be eliminated; and if the voltage $V_{b2}$ is equal to $V_{com}$, the transistor T2 and the capacitor C2 can be eliminated.

Figure 11A:
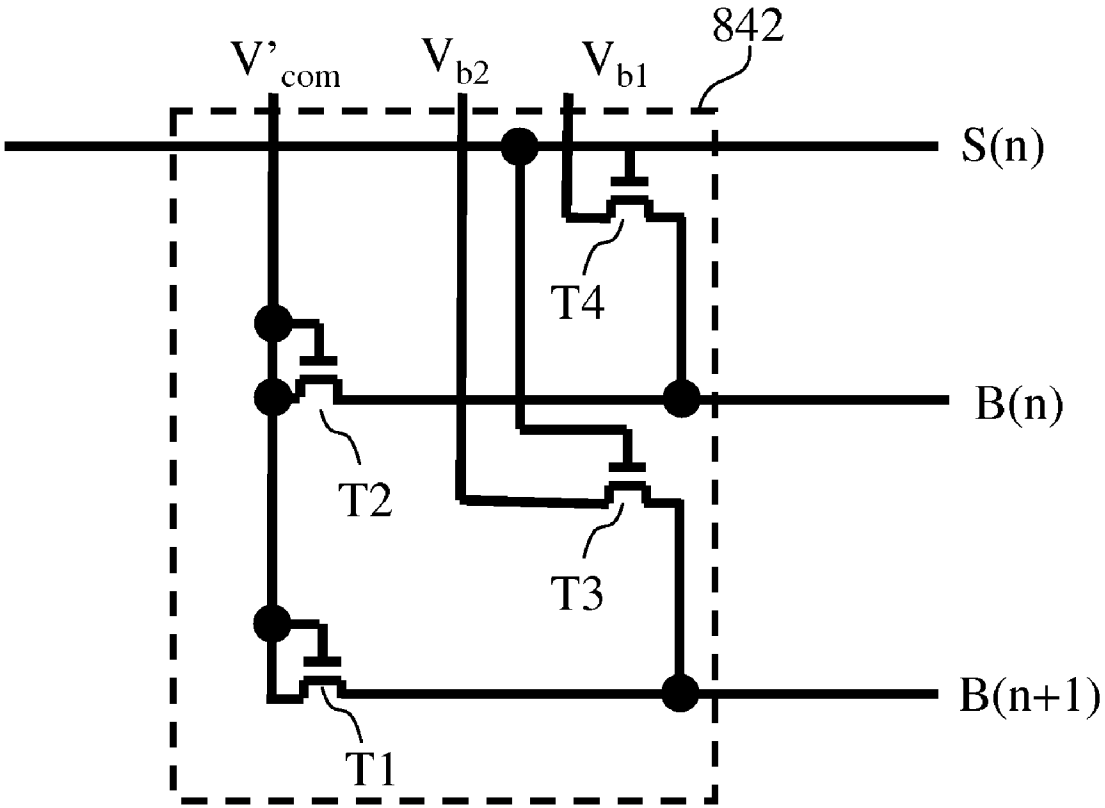
Figure 11B:
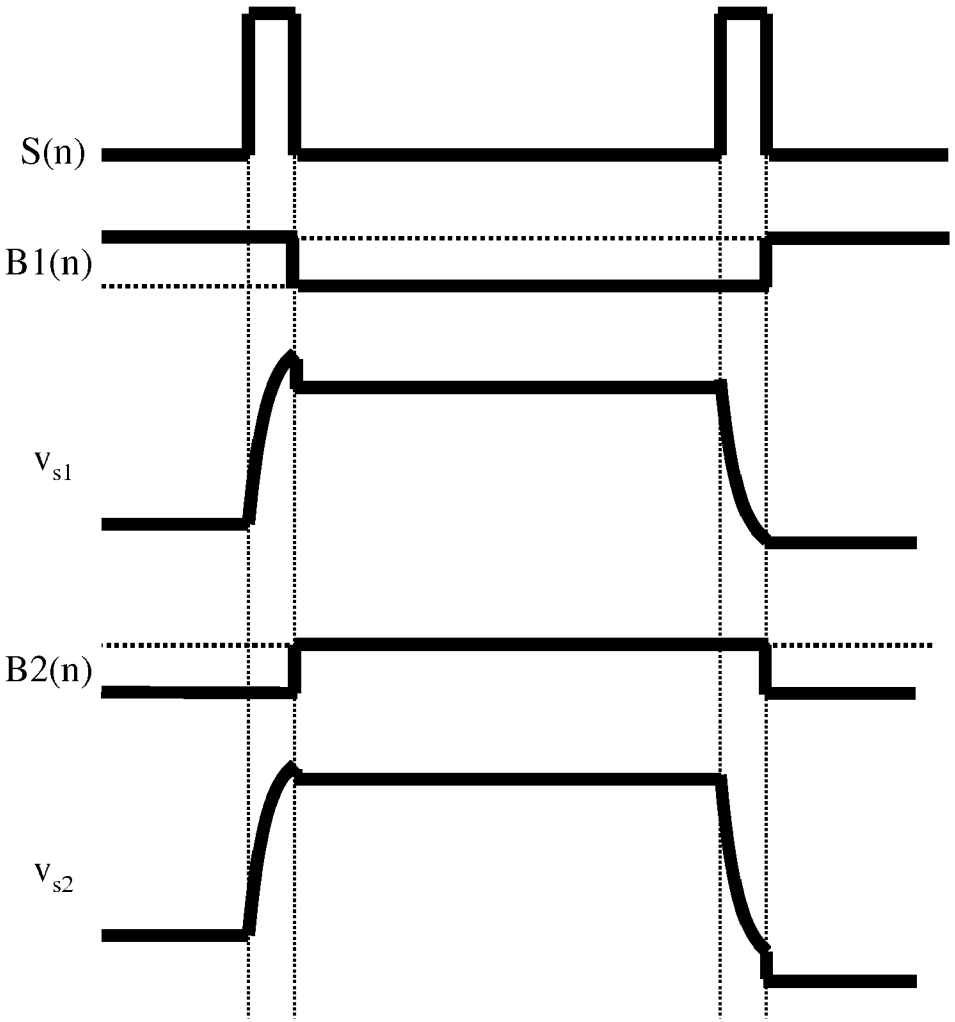

FIG. 11A is a circuit diagram showing a third bias unit 842 configured to be electrically connected to the scan line S(n). The bias unit 842 includes thin film transistors T1 to T4, wherein the transistors T1 and T2 always turn on to serve as resistors. Please refer also to FIG. 11B, which shows signal waveforms of the bias unit 842 and its corresponding first sub-pixel and second sub-pixel. In the first frame time period f1, the scan line S(n) is enabled such that the transistors T3 and T4 turn on. So, the levels of the bias lines B1(n) and B2(n) are respectively changed to the levels of $V_{b1}$ and $V_{b2}$. After the scan line S(n) is disabled and when the scan line S(n+1) is enabled, the transistors T3 and T4 turn off. So, the levels of the bias lines B1(n) and B2(n) are changed to $V'_{com}$.

If the polarity switching method by dot inversion is utilized, the polarities of the voltages $V_{b1}$ and $V_{b2}$ have to be changed with the switching of each frame. The polarity of $V_{b1}$ in the previous frame time period f0 is different from that of $V_{b1}$ in the first frame time period f1. The polarity of $V_{b2}$ in the previous frame time period f0 is different from that of $V_{b2}$ in the first frame time period f1. In addition, one of the voltages $V_{b1}$ and $V_{b2}$ may be set to be equal to the voltage $V'_{com}$. If the voltage $V_{b1}$ is equal to $V'_{com}$, the transistors T2 and T4 may be eliminated. If the voltage $V_{b2}$ is equal to $V'_{com}$, the transistors T1 and T3 may be eliminated.

Figure 12A:
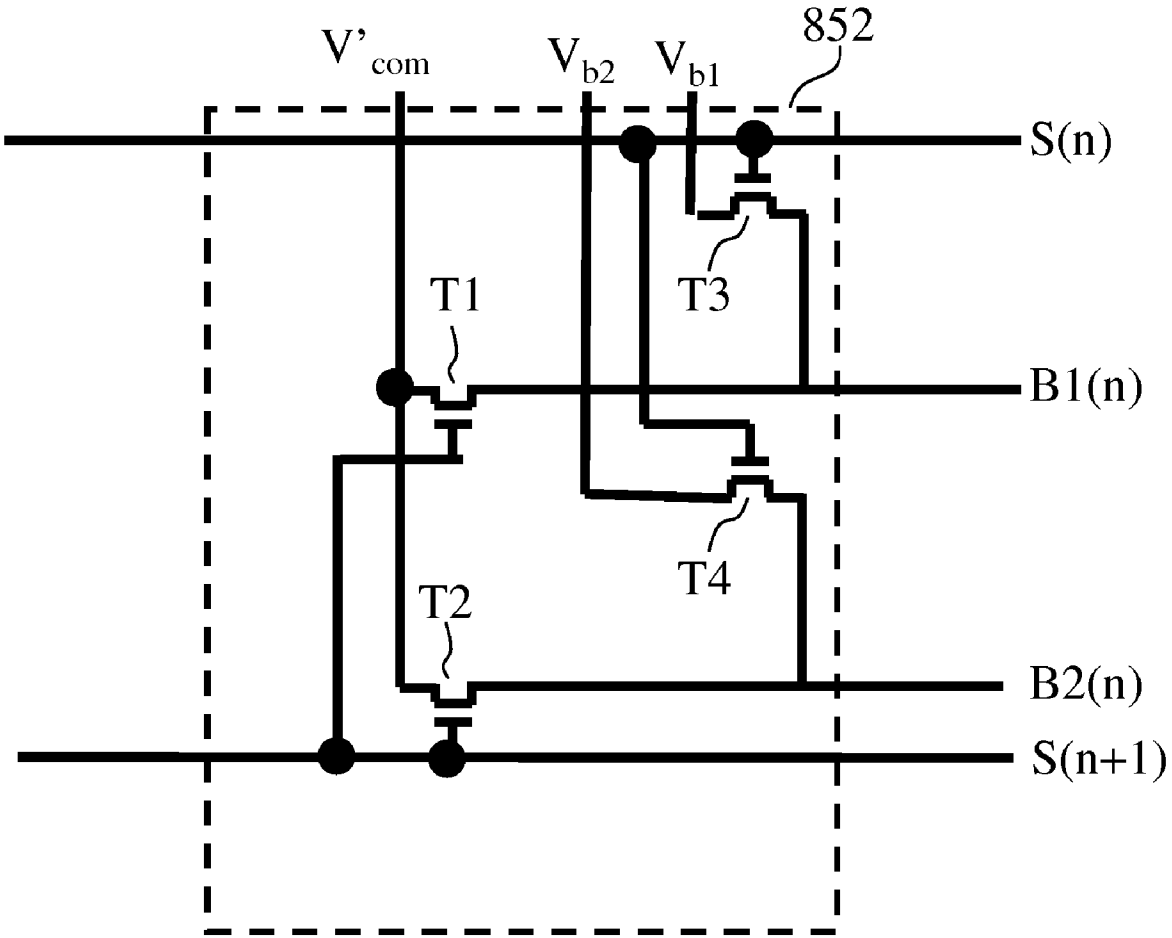
Figure 12B:
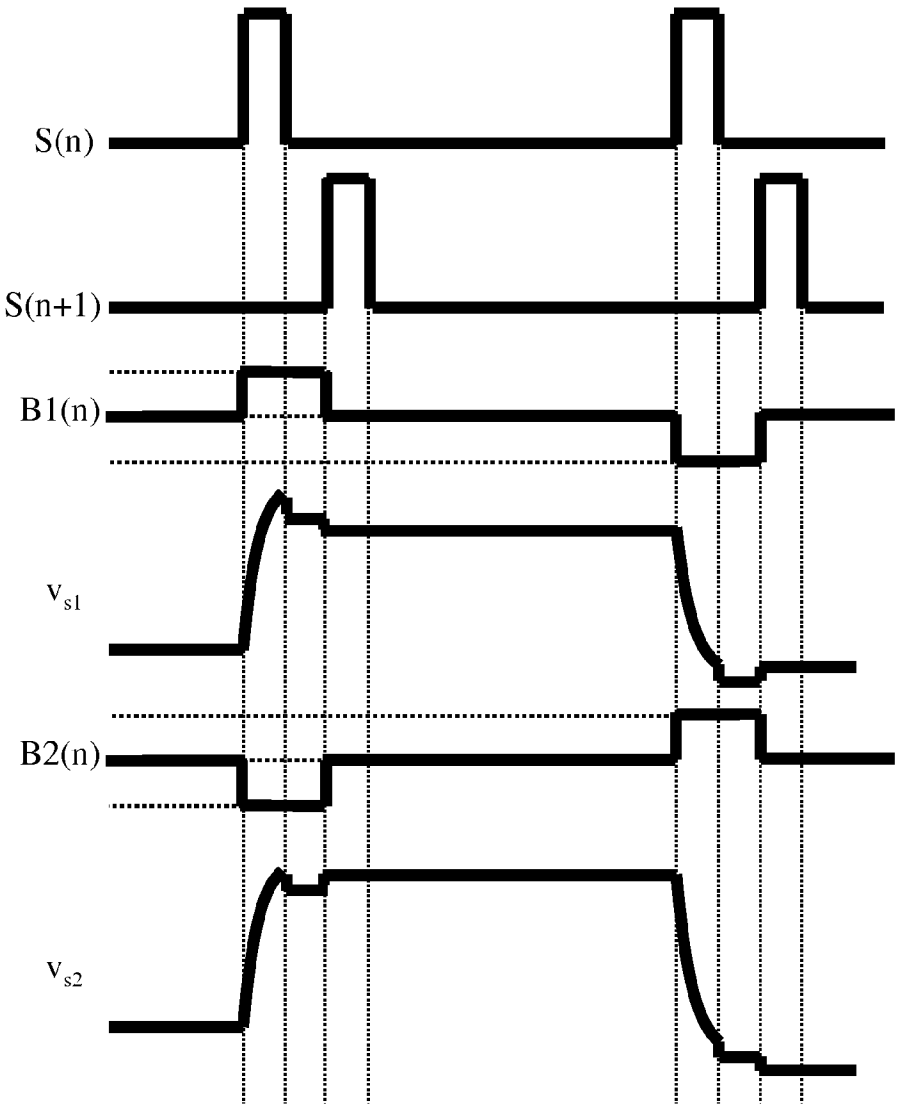

FIG. 12A is a circuit diagram showing a fourth bias unit 852, which is electrically connected to the scan lines S(n) and S(n+1) in this example. The bias unit 852 includes thin film transistors T1 to T4. Please refer also to FIG. 12B, which shows signal waveforms of the bias unit 852 and its corresponding first sub-pixel and second sub-pixel. In the first frame time period f1, the scan line S(n) is enabled such that the transistors T3 and T4 turn on. Accordingly, the levels of the bias lines B1(n) and B2(n) are respectively changed to the levels of $V_{b1}$ and $V_{b2}$. After the scan line S(n) is disabled and when the scan line S(n+1) is enabled, the transistors T3 and T4 turn off, the transistors T1 and T2 turn on, and the levels of the bias lines B1(n) and B2(n) are changed to $V'_{com}$.

If the polarity switching method by the dot inversion is utilized, the polarities of the voltages $V_{b1}$ and $V_{b2}$ have to be switched with the switching of each frame. In addition, one of the voltages $V_{b1}$ and $V_{b2}$ may be set to be equal to the voltage $V'_{com}$. If the voltage $V_{b1}$ is equal to $V'_{com}$, the transistors T1 and T3 may be eliminated and B1(n) is directly coupled to $V'_{com}$. If the voltage $V_{b2}$ is equal to $V_{com}'$, the transistors T2 and T4 may be eliminated, and B2(n) is directly coupled to $V'_{com}$.

Pixel Layout

Figures 13A, 13B, 13C:
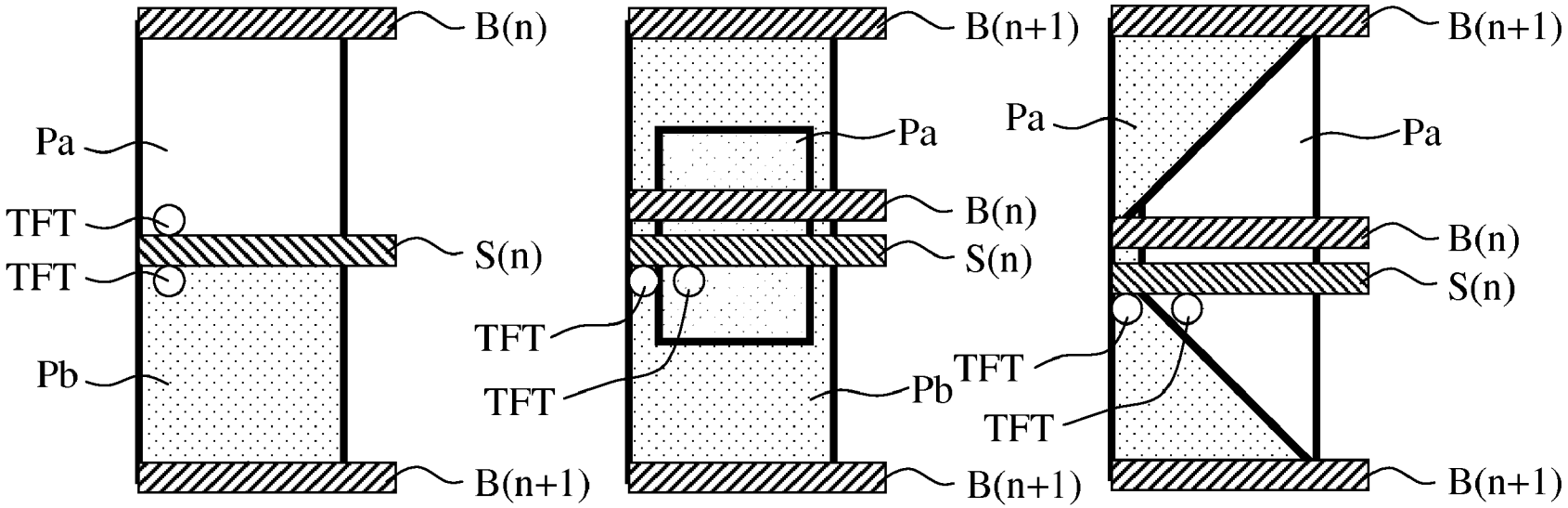
FIGS. 13A to 13C show layouts of three pixels.

The first and second embodiments divide one pixel into a first sub-pixel Pa and a second sub-pixel Pb, and the layouts of the first sub-pixel Pa and the second sub-pixel Pb may have any arbitrary shape. Some examples will be described in the following. FIG. 13A shows a first layout of the pixel, wherein the first sub-pixel Pa and the second sub-pixel Pb respectively occupy upper and lower portions of the pixel, and each of the first sub-pixel Pa and the second sub-pixel Pb includes one TFT (Thin-Film Transistor). FIG. 13B shows a second layout of the pixel, wherein the first sub-pixel Pa is located in the middle of the pixel, the second sub-pixel Pb surrounds the first sub-pixel Pa, and each of the first sub-pixel Pa and the second sub-pixel Pb includes one TFT. FIG. 13C shows a third layout of the pixel, wherein the first sub-pixel Pa is a trapezoidal pixel, the other portion pertains to the second sub-pixel Pb, and each of the first sub-pixel Pa and the second sub-pixel Pb includes one TFT.

FIGS. 13A to 13C illustrate several examples of the layout. However, one of ordinary skill in the art may use the layout with any other shape to construct the pixel structure of the invention.

Pixel Structure

Figure 14A:
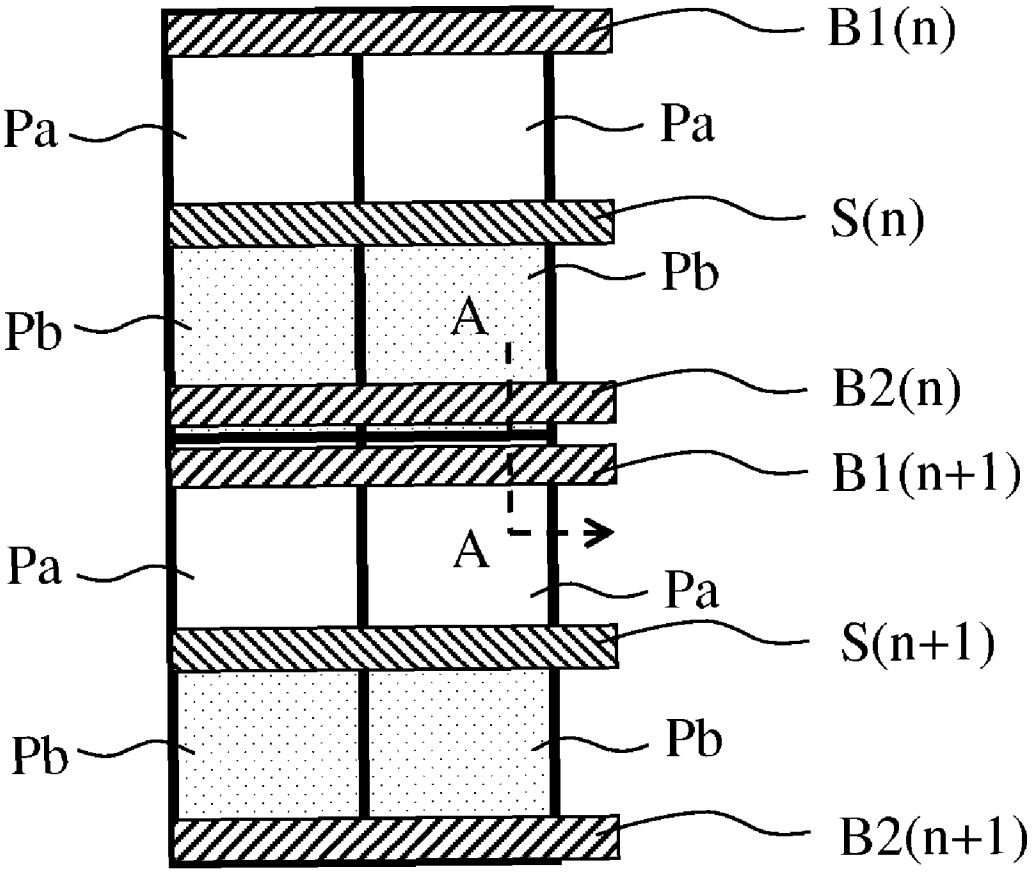
FIG. 14A is a schematic illustration showing a LCD panel 100 of the first embodiment.
Figure 14B:
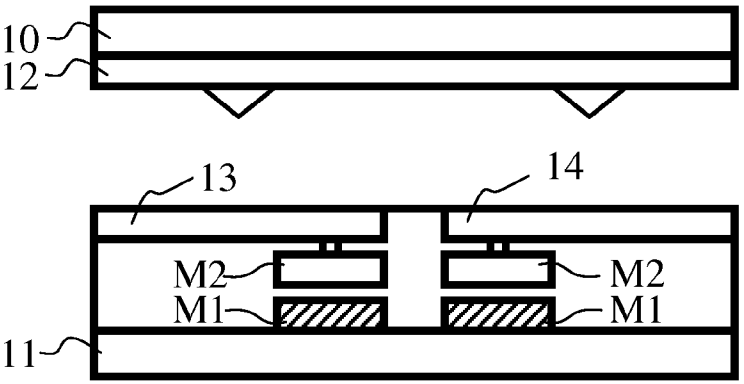
FIG. 14B is a cross-sectional view taken along a line A-A to show a first LCD panel structure.

The LCD panel 100 of the first embodiment may have several configurations. Four examples will be described in the following. FIG. 14A is a schematic illustration showing the LCD panel 100 of the first embodiment. FIGS. 14B to 14E are cross-sectional views showing various structures of the LCD panel 100. FIG. 14B is a cross-sectional view taken along a line AA' to show a first LCD panel structure. The LCD panel 100 includes an upper substrate 10, a common electrode 12, a lower substrate 11, transparent electrodes 13 and 14, and first metal layers M1 and second metal layers M2. The two second metal layers M2 respectively couple the transparent electrodes 13 and 14 to the data lines. The two first metal layers M1 constitute the bias lines B1 and B2. The first metal layer M1 and the corresponding second metal layer M2 constitute the storage capacitor $C_{st}$.

Figure 14C:
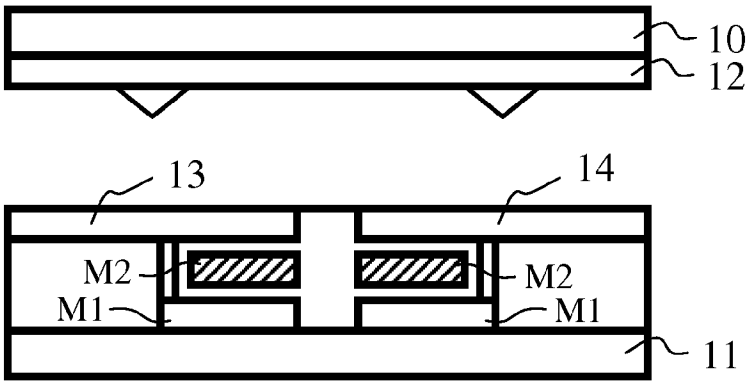
FIG. 14C is a cross-sectional view taken along the line A-A to show a second LCD panel structure.
Figure 14D:
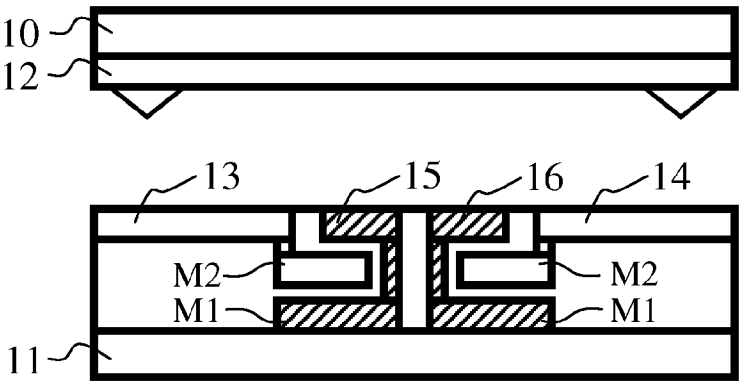
FIG. 14D is a cross-sectional view taken along the line A-A to show a third LCD panel structure.
Figure 14E:
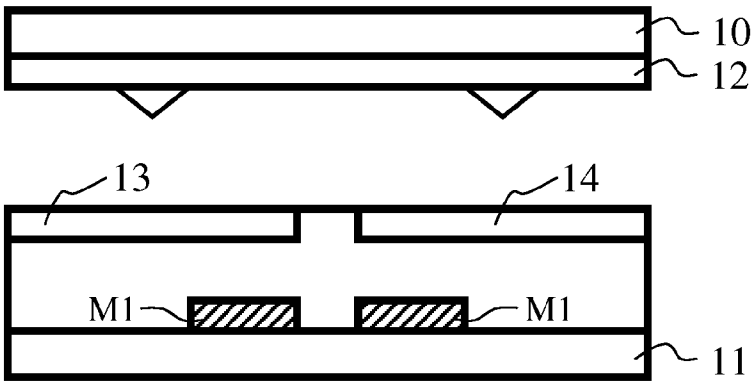
FIG. 14E is a cross-sectional view taken along the line A-A to show a fourth LCD panel structure.

FIG. 14C is a cross-sectional view taken along the line A-A to show a second LCD panel structure, which is different from the first structure in that the transparent electrodes 13 and 14 are electrically connected to the first metal layers M1, and the second metal layers M2 constitute the bias lines B1 and B2. FIG. 14D is a cross-sectional view taken along the line AA' to show a third LCD panel structure, which is different from the first structure in that the first metal layers M1 are further electrically connected to the transparent electrodes 15 and 16 in order to increase the capacitance of the storage capacitor $C_{st}$. FIG. 14E is a cross-sectional view taken along the line AA' to show a fourth LCD panel structure, which is different from the first structure in that the second metal layers have been eliminated.

Figure 15A:
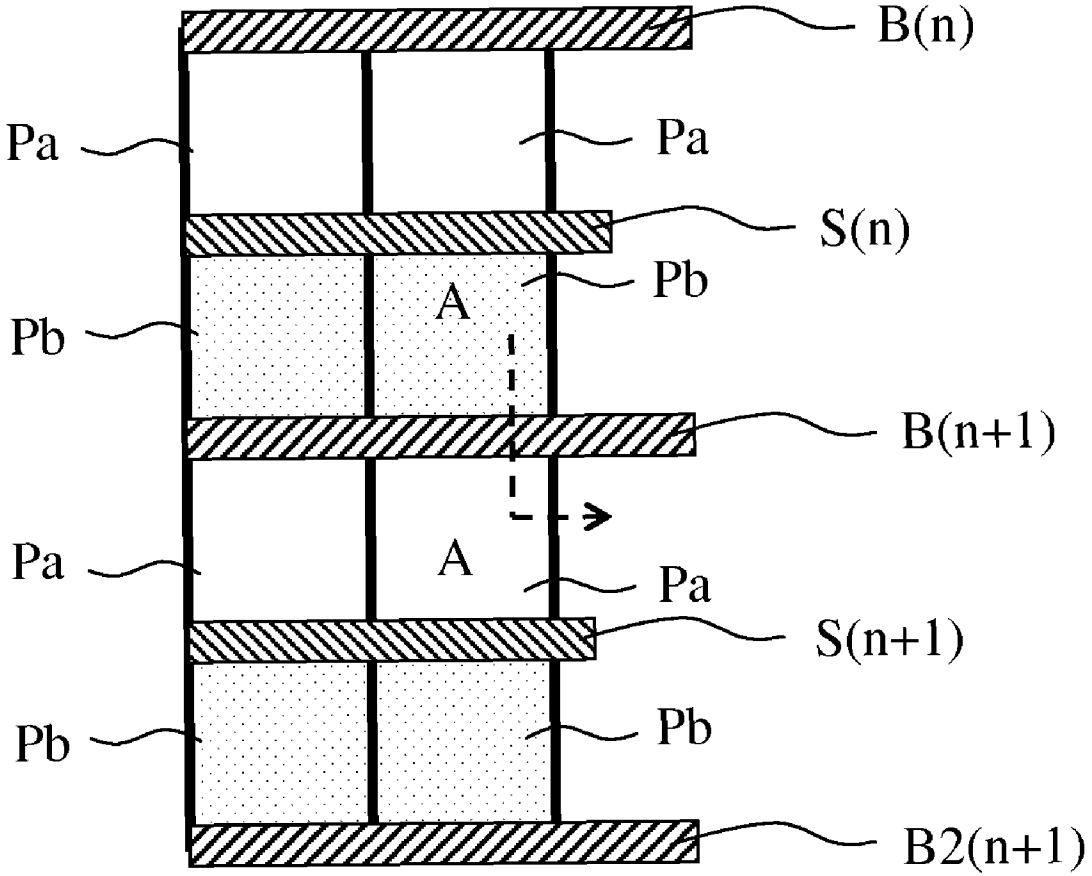
FIG. 15A is a schematic illustration showing the LCD panel 400 of the second embodiment.
Figure 15B:
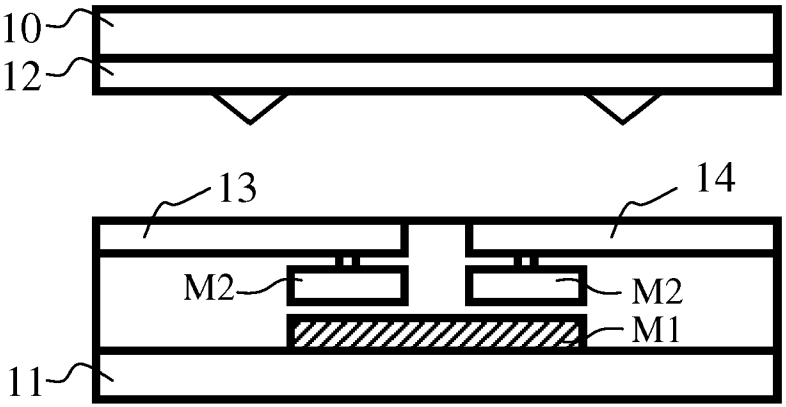
FIGS. 15B to 15E are cross-sectional views showing various structures of the LCD panel 400.

The LCD panel 400 of the second embodiment may have several structures, and four examples will be illustrated. FIG. 15A is a schematic illustration showing the LCD panel 400 of the second embodiment. FIGS. 15B to 15E are cross-sectional views showing various structures of the LCD panel 400. FIG. 15B is a cross-sectional view taken along a line A-A to show a first structure of the LCD panel 400. The LCD panel 400 includes an upper substrate 10, a common electrode 12, a lower substrate 11, transparent electrodes 13 and 14, a first metal layer M1 and two second metal layers M2. The two second metal layers M2 respectively couple the transparent electrodes 13 and 14 to the data lines. The first metal layer M1 constitutes the bias line B. The first metal layer M1 and its corresponding second metal layers M2 constitute the storage capacitor $C_{st}$.

Figure 15C:
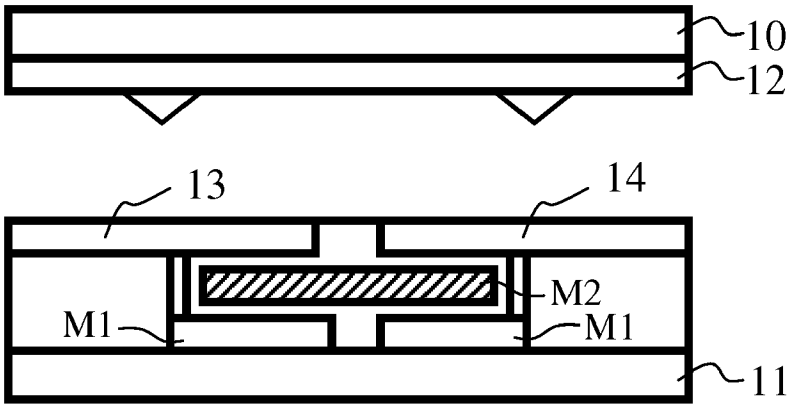
Figure 15D:
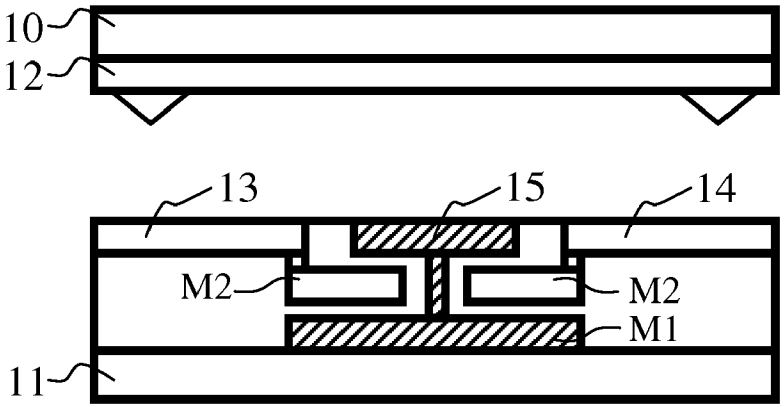
Figure 15E:
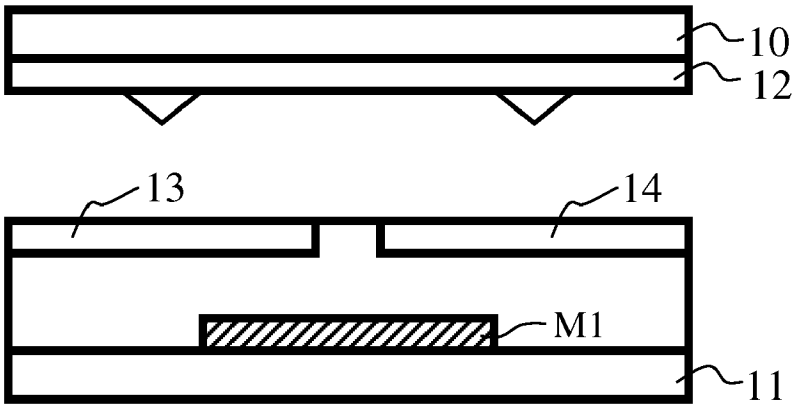

FIG. 15C is a cross-sectional view taken along the line AA' to show a second structure of the LCD panel 400, which is different from the first structure in that the transparent electrodes 13 and 14 are electrically connected to the first metal layers M1, and the second metal layer M2 constitutes the bias lines B. FIG. 15D is a cross-sectional view taken along the line AA' to show a third structure of the LCD panel 400, which is different from the first structure in that the first metal layer M1 is further electrically connected to the transparent electrode 15 in order to increase the capacitance of the storage capacitor $C_{st}$. FIG. 15E is a cross-sectional view taken along the line AA' to show a fourth structure of the LCD panel 400, which is different from the first structure in that the second metal layers have been eliminated.

The embodiments enable the sub-pixels in one pixel of the multi-domain LCD panel to have the driving voltages, which are slightly different from each other, so as to reduce the color difference and enhance the frame stability and the display quality.

While the invention has been described by way of example and in terms of a limited number of embodiments, it is to be understood that the invention is not limited thereto. On the contrary, the present invention is intended to cover various modifications and similar arrangements and procedures, and the scope of the appended claims therefore should be accorded the broadest interpretation so as to encompass all such modifications and similar arrangements and procedures.

What is claimed is:

1. An LCD (Liquid Crystal Display) panel, comprising:

a data line extending in a first direction;

a scan line extending in a second direction substantially perpendicular to the first direction;

a pixel formed at an intersection between the data line and the scan line, the pixel comprising:

a first sub-pixel, which comprises a first switch, a first liquid crystal capacitor and a first storage capacitor, wherein the first switch has a first terminal coupled to the scan line, a second terminal coupled to the data line, and a third terminal coupled to a first terminal of the first liquid crystal capacitor and a first terminal of the first storage capacitor; and a second sub-pixel, which comprises a second switch, a second liquid crystal capacitor and a second storage capacitor, wherein the second switch has a first terminal coupled to the scan line, a second terminal coupled to the data line, and a third terminal coupled to a first terminal of the second liquid crystal capacitor and a first terminal of the second storage capacitor;

a first bias line electrically connected to a second terminal of the first storage capacitor; and a second bias line electrically connected to a second terminal of the second storage capacitor, wherein:

said first and second switches are configured to turn on, when the scan line is enabled, to enable a signal on the data line to be transmitted to the first sub-pixel and the second sub-pixel; and after the scan line is disabled, levels of the first bias line and the second bias line are configured to change between a high and a low voltage level only once until the scan line is enabled again to make pixel voltages of the first sub-pixel and the second sub-pixel different from each other.

2. The panel according to claim 1, wherein the first bias line has a first level before the scan line is enabled, the first level when the scan line is enabled, and a second level after the scan line is disabled.

3. The panel according to claim 1, wherein the second bias line has a third level before the scan line is enabled, the third level when the scan line is enabled, and a fourth level after the scan line is disabled.

4. The panel according to claim 1, wherein the first bias line has a first level before the scan line is enabled, a second level when the scan line is enabled, and the first level after the scan line is disabled.

5. The panel according to claim 1, wherein the second bias line has a third level before the scan line is enabled, a fourth level when the scan line is enabled, and the third level after the scan line is disabled.

6. The panel according to claim 1, wherein the LCD panel comprises a gate driver, which comprises a plurality of output pins for respectively driving the scan line, the first bias line and the second bias line.

7. The panel according to claim 1, wherein the LCD panel comprises a first gate driver for driving the scan line, and a second gate driver for driving the first bias line and the second bias line.

8. The panel according to claim 7, wherein the first gate driver and the second gate driver are disposed on one side of the LCD panel.

9. The panel according to claim 7, wherein the first gate driver and the second gate driver are disposed on opposite sides of the LCD panel.

10. The panel according to claim 1, wherein the LCD panel comprises a first gate driver and a second gate driver, which are disposed on opposite sides of the LCD panel and commonly drive the scan line, and a third gate driver and a fourth gate driver, which are disposed on the opposite sides of the LCD panel and commonly drive the first bias line and the second bias line.

11. The panel according to claim 1, comprising a plurality of the scan lines defined as first scan lines and second scan lines, and a plurality of the pixels defined as first pixels and second pixels, wherein the first pixels and the second pixels are respectively arranged in directions perpendicular to each other, and the second bias line is shared by the second sub-pixel of the first pixel and the first sub-pixel of the second pixel.

12. The panel according to claim 11, further comprising a bias generating circuit, which is formed on a substrate of the LCD panel, for driving the first bias line and the second bias line according to the first scan line and the second scan line.

13. The panel according to claim 12, wherein the bias generating circuit comprises at least one bias unit, which is electrically connected to the first scan line and the second scan line and is electrically connected to the first bias line and the second bias line.

14. The panel according to claim 1, wherein a phase difference between the levels of the first bias line and the second bias line ranges from 180 to 360 degrees.

15. The panel according to claim 1, further comprising a gate driver electrically coupled to the scan line for outputting to the scan line a plurality of scan signals regularly spaced in time by a frame period between each pair of successive said scan signals;

wherein, during the entire frame period between two successive said scan signals, the level of each of the first bias line and the second bias line is configured to change no more than two times.

16. The panel according to claim 15, further comprising a bias generating circuit different from the gate driver and electrically coupled to at least one of the first and second bias lines for switching the level of at least one of the first and second bias signals, respectively, no more than two times during each frame period.

17. The panel according to claim 15, wherein the gate driver is electrically coupled to at least one of the first and second bias lines for switching the level of at least one of the first and second bias signals, respectively, no more than two times during each frame period.

18. An LCD (Liquid Crystal Display), comprising:

a source driver;

a gate driver for outputting a plurality of scan signals regularly spaced in time by a frame period between each pair of successive said scan signals;

a bias generating circuit for outputting a first bias signal and a second bias signal according to each of the scan signals; and a LCD panel, which comprises:

a data line, which extends in a first direction and is electrically connected to the source driver;

a scan line, which extends in a second direction substantially perpendicular to the first direction, and is electrically coupled to the gate driver for receiving the scan signals;

a pixel formed at an intersection of the data line and the scan line, the pixel comprising:

a first sub-pixel, which comprises a first switch, a first liquid crystal capacitor and a first storage capacitor, wherein the first switch has a first terminal coupled to the scan line, a second terminal coupled to the data line, and a third terminal coupled to a first terminal of the first liquid crystal capacitor and a first terminal of the first storage capacitor; and a second sub-pixel, which comprises a second switch, a second liquid crystal capacitor and a second storage capacitor, wherein the second switch has a first terminal coupled to the scan line, a second terminal coupled to the data line, and a third terminal coupled to a first terminal of the second liquid crystal capacitor and a first terminal of the second storage capacitor;

a first bias line, which is electrically coupled to the bias generating circuit for receiving the first bias signal and is electrically connected to a second terminal of the first storage capacitor; and a second bias line, which is electrically coupled to the bias generating circuit for receiving the second bias signal and is electrically connected to a second terminal of the second storage capacitor, wherein:

said first and second switches are adapted to turn on, when the scan line is enabled by one of the scan signals applied by the gate driver to the scan line, to enable a signal applied by the source driver to the data line to be transmitted to the first sub-pixel and the second sub-pixel; and said bias generating circuit is configured to change, after the scan line is disabled, levels of the first bias signal and the second bias signal between a high voltage level and a low voltage level only once during the entire frame period from said one scan signal to the successive scan signal, to make pixel voltages of the first sub-pixel and the second sub-pixel be different from each other.

* * * * *